US005168827A

United States Patent [19]

Junker

[11] Patent Number: 5,168,827

[45] Date of Patent: Dec. 8, 1992

[54] SIGNALING DEVICE

[76] Inventor: Wilhelm Junker, Reutlinger Str. 14, D-7150 Backnang, Fed. Rep. of Germany

[21] Appl. No.: 613,492

[22] PCT Filed: Jan. 23, 1990

[86] PCT. No.: PCT/EP90/00127

§ 371 Date: Oct. 31, 1990

§ 102(e) Date: Oct. 31, 1990

[87] PCT. Pub. No. W090/08229

PCT Pub. Date Jul. 26, 1990

[30] Foreign Application Priority Data

| | | | |
|---|---|---|---|
| Jan. 23, 1989 | [DE] | Fed. Rep. of Germany | 3901873 |
| Mar. 13, 1989 | [DE] | Fed. Rep. of Germany | 8903093[U] |
| Oct. 24, 1989 | [DE] | Fed. Rep. of Germany | 8912563[U] |
| Dec. 30, 1989 | [DE] | Fed. Rep. of Germany | 8915303[U] |

[51] Int. Cl.[5] ..... E01F 9/04

[52] U.S. Cl. ..... 116/63 P; 116/63 C; 40/612; 404/10

[58] Field of Search ..... 116/63 R, 63 P, 63 C; 40/608, 612; 256/1, 13.1; 404/6, 9–12

[56] References Cited

U.S. PATENT DOCUMENTS

| | | | |
|---|---|---|---|
| 1,337,947 | 4/1920 | O'Toole . | |
| 2,136,709 | 11/1938 | Robertson . | |
| 2,153,392 | 4/1939 | Robertson . | |
| 3,092,371 | 6/1963 | Knudsen . | |
| 3,174,412 | 3/1965 | Boyd et al. . | |
| 3,380,428 | 4/1968 | Abrams . | |
| 3,451,319 | 6/1969 | Gubela | 404/9 X |
| 3,502,007 | 3/1970 | Andersson | 40/607 X |
| 3,952,690 | 4/1976 | Rizzo et al. | 116/63 P |
| 4,154,037 | 5/1979 | Anderson | 52/296 |
| 4,564,309 | 1/1986 | Björlund | 404/10 |
| 4,610,432 | 9/1986 | Lewis et al. | 256/65 |

FOREIGN PATENT DOCUMENTS

| | | | |
|---|---|---|---|
| 213114 | 3/1987 | European Pat. Off. . | |
| 257226A2 | 3/1988 | European Pat. Off. . | |
| 257226A3 | 3/1988 | European Pat. Off. . | |
| 1926703 | 11/1970 | Fed. Rep. of Germany . | |
| 2233994 | 2/1974 | Fed. Rep. of Germany | 404/6 |
| 2522935 | 12/1976 | Fed. Rep. of Germany . | |
| 2923501 | 12/1980 | Fed. Rep. of Germany . | |
| 2952034 | 6/1981 | Fed. Rep. of Germany . | |
| 8337204 | 6/1984 | Fed. Rep. of Germany . | |
| 3345797 | 6/1985 | Fed. Rep. of Germany . | |
| 8509372 | 6/1985 | Fed. Rep. of Germany . | |
| 3412999 | 7/1985 | Fed. Rep. of Germany . | |
| 3413163 | 10/1985 | Fed. Rep. of Germany . | |
| 3434868 | 4/1986 | Fed. Rep. of Germany . | |
| 3718440 | 12/1988 | Fed. Rep. of Germany . | |
| 8800092 | 12/1988 | Fed. Rep. of Germany . | |
| 8902167 | 9/1989 | Fed. Rep. of Germany . | |
| 2184164 | 11/1973 | France . | |
| 2190979 | 1/1974 | France . | |
| 996961 | 6/1965 | United Kingdom . | |
| 2144789 | 3/1985 | United Kingdom . | |
| 2156409A | 10/1985 | United Kingdom . | |
| 2183276 | 6/1987 | United Kingdom | 404/10 |
| 2183699 | 6/1987 | United Kingdom . | |
| 2193990 | 2/1988 | United Kingdom | 404/9 |
| WO83/01972 | 6/1983 | World Int. Prop. O. . | |

*Primary Examiner*—William A. Cuchlinski, Jr.
*Assistant Examiner*—W. Morris Worth
*Attorney, Agent, or Firm*—Foley & Lardner

[57] ABSTRACT

The signaling device (20) has a signaling body (21) and a holding device (22). The signaling body (21) is designed as a cornet-like hollow body which has four wall regions (24; 27) adjoining one another in the circumferential direction, of which two diametrically opposite wall regions (24) form the wide sides of the signaling body (21) and of which the other two likewise diametrically opposite wall regions (27) form the narrow sides of the signaling body (21). The wall regions (27) on the narrow side have the form of a conical shell. The wall regions (24) on the wide side are preferably flat. Between the signaling body (21) and the holding device (22) there is a coupling device (23). The wall regions (27) on the narrow side have above the foot (28) of the signaling body (21) in each case a recess (33; 34), which has a certain height and which extends in the circumferential direction up to the transitional point with the neighboring wall region (24) on the wide side. The holding device may be designed as a base plate (22) for adhesively fixing, as a foot plate for setting up or as a foot bearing bar for setting up and arranging in line a plurality of signaling devices (20).

22 Claims, 16 Drawing Sheets

Schnitt A÷A

Fig.9
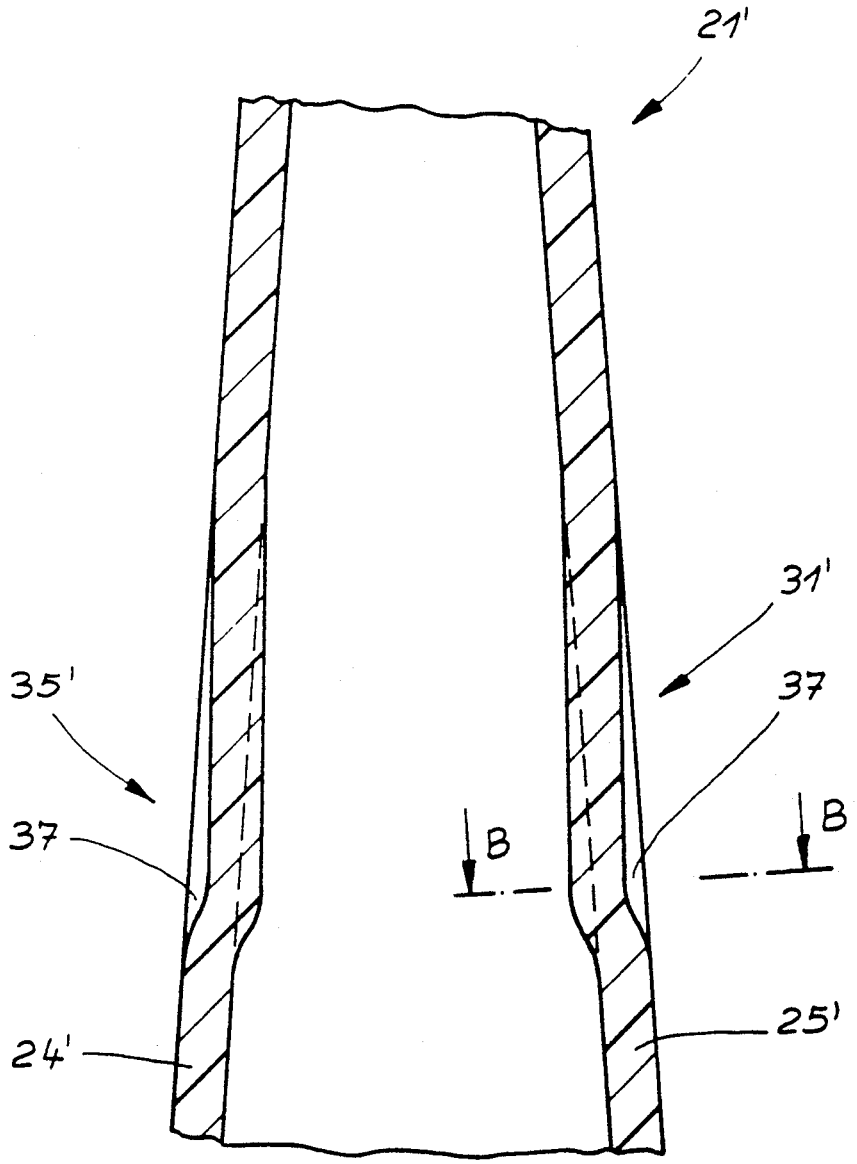
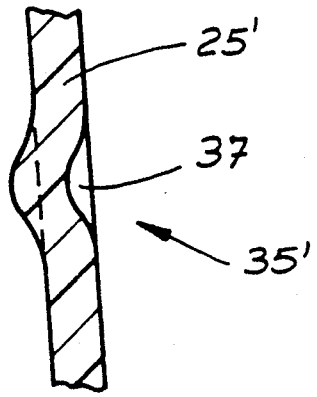
Fig.10

Fig. 22
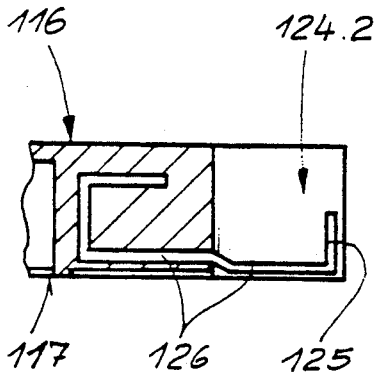
Fig. 23
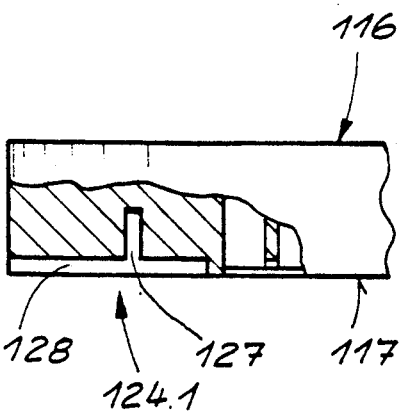
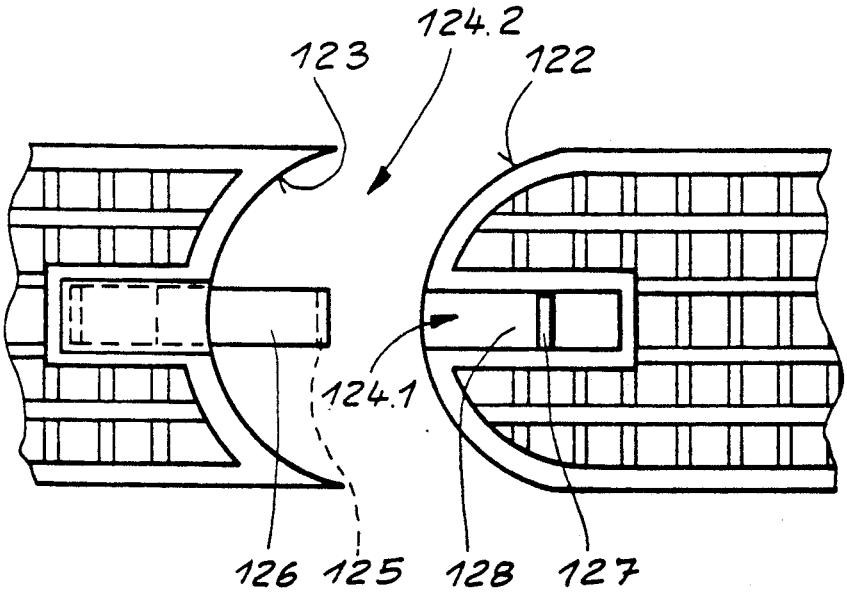
Fig. 24
Fig. 25

SIGNALING DEVICE

At road construction sites, in particular at sites on highways and freeways, the traffic flows often have to be led past a section of road which departs from the usual lane markings. The remaining lane width is usually too small to keep the traffic flows heading opposite each other apart by broad medians with quite high lane dividers. Therefore, usually signaling devices of a small overall height are used, such as for example signaling studs with and without reflectors. In addition, there are also signaling devices of somewhat greater height of about 25 to 30 mm. These are usually used in addition to the signaling studs, to be precise usually at somewhat greater intervals than the signaling studs, in alternation with the latter. These signaling devices have a sheet-shaped signaling body, on the lower edge of which two tongues are molded-on, each of which is angled off to one of the two sides perpendicularly to the wide side of the sheet-shaped signaling body. Adhesive is applied to the underside of this tongue and the signaling device is thereby stuck on the roadway at the place it is put to use.

These signaling devices are so low that they can scarcely perform their function as a signaling device. A further disadvantage is that, due to its small wall thickness, the sheet-shaped signaling body has only a relatively small moment of resistance to bending about a horizontal bending line. Therefore, when driven over, the signaling bodies are usually permanently deformed to such an extent that afterwards they can no longer right themselves completely to the vertical. Consequently, their signaling function is likewise diminished.

A similar diminution of the signaling function is noticeable with these signaling devices if in summer they are exposed to quite a strong heat effect in the blazing sun. This often causes the material to soften to such an extent that the sheet-shaped signaling body leans to the side even without the effects of external forces, due to its own weight alone. What is particularly unfortunate about this is that, after cooling down, the signaling bodies retain this leaning shape forever.

The invention in a first aspect is based on the object of providing a signaling device which, although on the one hand considerably lower than a beacon stand, on the other hand has a better signaling effect and in particular a greater righting capability than the conventional signaling devices with a sheet-shaped signaling body.

Due to the fact that in the signaling device of the invention the signaling body is designed as a hollow body having two wall regions on the wide side spaced from each other by the horizontal extent of the wall regions on the narrow side, a signaling body with a given wall thickness is from the outset provided with a significantly greater moment of resistance to bending than is the case with the sheet-shaped signaling body of the known signaling devices. The design of the wall regions on the narrow side in the form of a cylindrical shell or a conical shell likewise contributes to increasing the dimensional stability of the signaling body.

In the case of the signaling device according to a further embodiments, adding to this is the fact that the two recesses present on the lower part of the signaling body above its foot, on the two wall regions on the narrow side, make it easier for the signaling body to bend over when it is driven into or even driven over by a vehicle. Since the two remaining wall regions along the wide side have a certain distance from each other, the elastic restoring forces in these wall regions produce a relatively great righting moment. As a result, the signaling body rights itself again quickly and completely after it has been pressed down completely onto the ground. This restoring moment also ensures that the signaling body does not lean to the side even under a strong heat effect, for example due to strong sunlight.

Due to the relatively large surface area of each of the two wall regions on the wide side of the signaling body, a relatively good visual signaling effect is produced. This can be increased still further by the signaling body being provided at least in the region of its wide sides with warning paints or its material in the first place being pigmented with a warning color, or by the wide sides being provided with a coating or with a foil having a pronounced warning function. If a reflective coating or a reflective foil is used, a very good signaling effect is achieved even in darkness or other poor light conditions.

Owing to the coupling device between the signaling body and the holding device, the signaling body can be easily detached, so that if need be, i.e. in the event of damage to or even destruction of the signaling body due to a collision, the signaling body can be easily exchanged. If the holding device has a base plate, which is fixed to the ground, the base plate does not have to be detached from the roadway. Even if the signaling body is connected to a foot plate, the signaling body can be easily exchanged if it has been very badly damaged or even destroyed due to a collision.

Irrespective of the relatively great dimensional stability of the signaling body overall, it can be elastically deformed very considerably as a whole due to the small wall thickness which it may have. As a result, the risk of the signaling body being destroyed in a collision is very small.

In a further development of the signaling device of the invention, the mold for the foot plate can be simplified considerably by either the space for a finished base plate being hollowed out on its upper side or, even more simply, by a finished base plate being inserted in the mold for the foot plate and thus molded-in right away with it during production of the foot plate. The use of a base plate as part of the foot plate also makes it possible to restrict the use of a plastic having quite a high dimensional stability and quite a high dimensional accuracy to the region of the coupling device and to use a material of lower quality, and thus generally of lower costs, for the remaining part of the foot plate. So-called recycling plastic, i.e. recycled plastic scrap, also may be used for this, for example.

Another development of the signaling device achieves the effect that the signaling body can be displaced with respect to the base plate or the foot plate only with a certain force. This prevents the signaling body from being separated from the base plate or the foot plate by small lateral forces, for instance when brushed from the side by a vehicle.

A further development of the signaling device achieves the effect that, when pushed into the grooves of the base plate or the foot plate, the signaling body can only be displaced as far as its operational position and it is then bearing against the stop. This prevents the signaling body from seating incorrectly in the base plate or in the foot plate due to an oversight of the attending personnel.

Another development of the signaling device makes it easier to introduce the foot of the signaling body into the grooves of the base plate or the foot plate.

Yet another development of the signaling device has the effect of increasing the deformation resistance of the signaling body specifically in the foot region which is subjected to particularly high loading when said body is driven over. This thereby reduces the risk of the foot of the signaling body being torn out from the grooves of the base plate or the foot plate.

With a still further development of the signaling device, the risk is reduced of the remote wall region on the wide side of the signaling body bulging out when the latter is driven into by a vehicle, which would prevent this wall region from bending in above the foot.

An alternate design of the signaling device achieves the effect that the base plate or the foot plate has at least in its central longitudinal section an at least approximately uniform height, so that a vehicle wheel can roll over it without bumping up and down a lot. As a result, the risk of an accident due to a sudden change in direction of the vehicle is reduced considerably. In addition, damage to the wheel rolling over the signaling device is prevented as a result.

With another development of the signaling device, an additional adhering effect above and beyond the frictional force produced by the weight of the signaling device at the place said device is set up is achieved by means of the adhesive platelets. The application of this development comes into consideration in particular whenever, in the case where the signaling device is to be used for some considerable time, the embodiment with the base plate which can be adhesively fixed to the ground is not available but only signaling devices with a foot plate. If, when such a signaling device has been removed, the adhesive effect of the adhesive on the underside of the adhesive platelet has greatly decreased, the adhesive platelet can be lifted out of the recess altogether and replaced by a new adhesive platelet. On new adhesive platelets, the adhesive layer on their underside is advantageously covered by a protective foil, which remains on the adhesive layer until the signaling device is to be adhesively fixed at the place it is put to use.

In the case of another development of the signaling device, the foot bearing bar has, owing to its dimensions, so great a weight of its own that the risk of it being pushed away when driven into at the side is very small, in any event considerably smaller than in the case of a signaling device with foot plate. Therefore, in the case of the foot bearing bar, as a rule adhesion to the roadway can be dispensed with, as a result of which all the disadvantages of adhesion automatically no longer apply.

A coupling device between two adjacent foot bearing bars improves the positional stability of the signaling device because, in addition to the effect of its own weight, neighboring foot bearing bars which are not driven into hold firm the foot bearing bar which is driven into.

The height chosen in the case of the foot bearing bar and the relatively slight inclination of the side walls have on the one hand a sufficiently great visual signaling effect, which makes the driver of a vehicle driving past it try not to drive over the foot bearing bar as far as possible. On the other hand, the height of the foot bearing bar is not so great that a vehicle, for example a passenger car, cannot drive over the foot bearing bar without danger. In particular, the risk that this may cause the bar to skid, as may happen with higher base bearing bars which are occasionally also used as lane dividers, is avoided. Unlike these higher base bearing bars, the signaling device of the invention poses no risk that a car driving over it may catch on top of the signaling device owing to its relatively small ground clearance and become stranded. Such a stranded vehicle would immediately become undriveable and unsteerable and represent a suddenly appearing stationary obstacle for the remaining flow of traffic. The danger for the occupants of such a stranded car is particularly great because as a rule the remaining traffic closely passes this vehicle on both sides, so that it is impossible for the occupants of the stranded car to leave the vehicle.

In spite of the relatively steep side walls of the foot bearing bar, its height is so low that a vehicle wheel rolling onto it can roll over it relatively easily, without the vehicle being subjected to an excessively strong rocking motion. This applies both to driving onto and to driving off the foot bearing bars. This means that a vehicle which has inadvertently driven over the foot bearing bars with the wheels of one side of the car can be steered back onto the original path without great difficulties and without an increased risk of skidding.

In the case of another development of the signaling device of the invention, a coupling device which is relatively simple to produce is provided for coupling together the foot bearing bars to form a longer chain, which has a certain adjustability, i.e. a certain capability of going around bends, without entailing any noticeable interruption in the mechanical signaling function of the foot bearing bar. The design of the parts of the coupling device makes it possible furthermore for the foot bearing bars of the signaling device to be laid out relatively quickly and simply and for the foot plates already to be coupled to one another at the same time. Thereafter, all that is needed to complete the signaling device is to fit on, i.e. push in, the cone or horn-shaped signaling body on the foot bearing bars. In the case of a further development of the signaling device, the close tolerances of the hollow parts with respect to the solid parts of the coupling device achieve the effect that only a very small swiveling motion of foot bearing bars neighboring each other is possible. As a result, the retaining effect of the foot bearing bars which are not driven into with respect to the foot bearing bars which are driven into is additionally increased, so that a lateral displacement of the signaling device is scarcely to be expected any longer. Nevertheless, these foot bearing bars can still be disposed in an adequate manner along a curved line.

In the case of a further development of the signaling device of the invention, in which the foot bearing bar has a significantly smaller width on its upper side than on its underside, and in which the far largest wall section of the side walls on the longitudinal side of the foot bearing bar has a cross-sectionally concave curvature, which merges at the bottom with a vertical wall section of but small height, a type of foot bed is created, onto which the vehicle wheel can roll even with the smallest angle of approach. As a result, the foot bearing bar is subjected to additional loading and is additionally pressed onto the ground. Even if the vehicle wheel then runs even further to the side and finally brushes against the upper part of the foot bearing bar, the foot bearing bar cannot be displaced any more to the side. If anything, the vehicle wheel then rolls over the foot bearing bar toward the other side. However, from there, the vehicle wheel can roll back just as easily onto the original side of the foot bearing bar. The signaling device maintains its predetermined position during all of these events.

The rolling of a vehicle wheel onto the foot bed takes place so steadily and with so little vertical movement that there are no major reactive effects on the vehicle itself, in particular no major impairments to the steerability and straight-travel occur. Even the complete rolling over and subsequent rolling back of the vehicle wheel takes place in a relatively smooth sequence of movements, so that even this does not give rise to major impairments of the handling of the vehicle, similar to the case when driving over a series of studs. This is of great significance because, for example when there is heavy two-lane traffic in convoy on one side of the signaling device, it is possible that a truck or its trailer traveling in the right lane could under certain circumstances come so close to a passenger car traveling in the left lane that the driver of the passenger car inadvertently or necessarily makes an evasive movement to the left in order to avoid a supposed or actually imminent collision, and the left wheels of his vehicle then roll onto or completely over the signaling device. Then, as quickly as the traffic situation allows, he can by slight steering movements steer his vehicle back completely into his lane.

The signaling bodies of the signaling device which are driven over by the vehicle wheels or the vehicle on or beyond the signaling device during such a maneuver bend over so easily and completely, owing to their special shape, onto the foot bearing bar that they cause no impairments either. After they have been driven onto or over, they right themselves again completely in the shortest time. The signaling device remains totally operational.

In the case of a signaling device designed according to a further embodiment, the previously described circumstances are achieved particularly well.

In the case of a another development of the signaling device of the invention, the entire weight of the signaling device is concentrated on the surface areas of the foot knobs. That has a corresponding increase in the surface loading as a consequence. Due to the fact that a material which has a lesser hardness than the material of the basic body is used for the foot knobs, the effect is achieved that the supporting surface of the foot knobs deforms more, due to its greater elasticity, into the small unevennesses of the ground at the place of use and, as a result, an additional interlocking between the foot knobs and the ground occurs, which increases the resistance to displacement of the signaling device considerably beyond the value which is provided by just the force of adhesion. In the case of a further development of the signaling device of the invention, this improvement in the security against slipping is achieved in a relatively simple and inexpensive way. Due to the fact that each foot knob is formed by an insert which is inserted in a recess of the foot bearing bar especially made for it, the insert is secured against lateral displacement by this interlocking alone, without any further measures, such as adhesion for instance, being needed for this, although these further measures are not ruled out. This design of the foot knobs gives them a great robustness and a correspondingly long service life. As a result, the risk of the foot knobs being damaged, in particular torn away, when sliding over projections or over sharp edges of a loading surface, as can occur in the case of foot knobs which are only adhesively fixed flat onto a smooth underside, is also virtually ruled out. This design of the foot knobs also makes it possible, if need be, to make an insert which is badly worn or even damaged on the standing surface fit for use again, at least temporarily, by the insert being turned around in the recess and used again with its rear surface as the new standing surface. If this is done, it is even possible to compensate for quite a considerable amount of wear by inserting some spacer or other between the upper side of the insert and the end face of the recess.

In the case of a further development of the signaling device of the invention, the increase in the security against displacement is achieved by the material used for the insert being given a surface similar to sandpaper on account of its starting material and its production process, which surface permits a good interlocking with the unevennesses of the ground which always exists. With the further development of the signaling device of the invention, the same effect is achieved by the material of the inserts on the one hand being elastically very compliant, and as a result able to deform easily into the unevennesses of the ground, and by the material on the other hand having a high tear strength or toughness, which prevents, in spite of the compliance of the material, the parts of the material of the insert which have penetrated into the depressions of the ground from being sheared off when a lateral force occurs.

Another development of the signaling device according has the effect of creating a gripping hole at the upper end of the signaling body, with an adjoining gripping strip, by means of which the signaling body can be grasped with the hand in a comfortable way and transported or moved to a different place. As long as the holding device is not too large and too heavy in design, it is even possible by means of the gripping hole and the gripping strip for the entire signaling device to be grasped and moved to a different place. The slit right through the gripping strip prevents, in the event of the signaling device being driven around or driven over, a downwardly protruding part on the underside of the vehicle from becoming hooked on the gripping strip and possibly tearing off the gripping strip or damaging or tearing off this part of the vehicle.

A still further development of the signaling device according to the invention has the effect of reducing the risk that the signaling body will be displaced out of its correct relative position with respect to the holding device as a result of forces acting on it laterally in the opposite sense to the pushing-on movement, for instance when the signaling body is brushed by a vehicle wheel.

BRIEF DESCRIPTION OF THE DRAWINGS

The invention is explained in further detail below with reference to several exemplary embodiments represented in the drawing, in which:

FIG. 9 shows a detail of a vertical section of a modified signaling body of the signaling device according to FIG. 1;

FIG. 10 shows a detail of a horizontal section of the signaling body taken along line B—B in FIG. 9;

FIG. 22 shows a detail of a longitudinal section of the end section of the foot bearing bar represented on the right in FIGS. 18 and 19;

FIG. 23 shows a partially sectional detail of the end section of the foot bearing bar on the left in FIGS. 18 and 19;

FIG. 24 shows a bottom view of the detail of the foot bearing bar according to FIG. 22;

FIG. 25 shows a bottom view of the detail of the foot bearing bar according to FIG. 23;

DETAILED DESCRIPTION OF PREFERRED EMBODIMENTS

Figure 1:
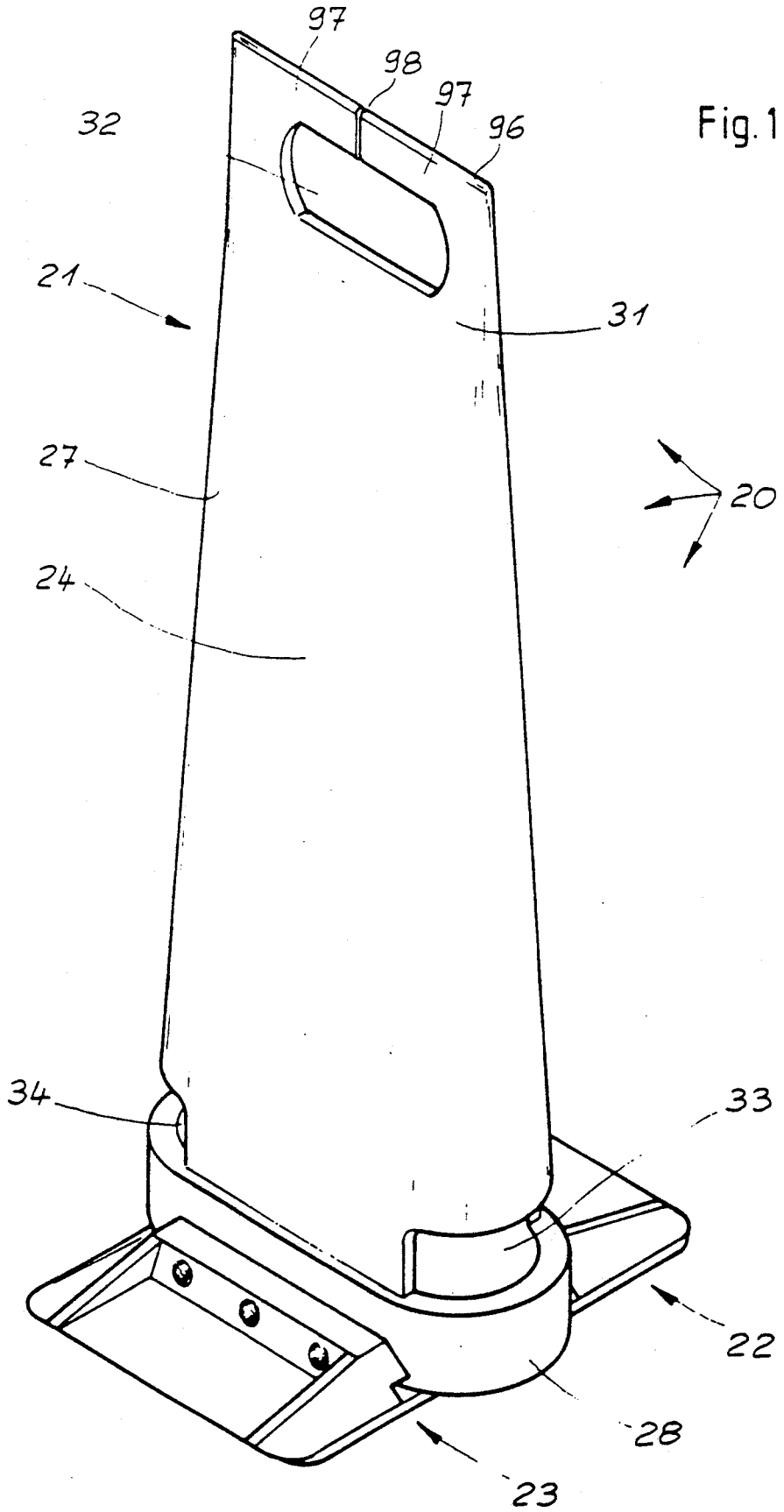
FIG. 1 shows a perspective view of the signaling device with a signaling body and a base plate.

The signaling device 20 shown in FIG. 1 has a signaling body 21 and a base plate 22; the signaling body 21 and the base plate 22 are detachably connected to each other by means of a coupling device 23.

The signaling body 21 is designed as a hollow body which is open at its lower end. As a result, it has a cone or horn-line appearance. The signaling body 21 has four wall regions, which adjoin one another in the circumferential direction. They are the two diametrically opposite wall regions 24 and 25, which have a larger horizontal extent and the two wall regions 26 and 27, which are likewise diametrically opposite each other and have a smaller horizontal extent.

Figure 2:
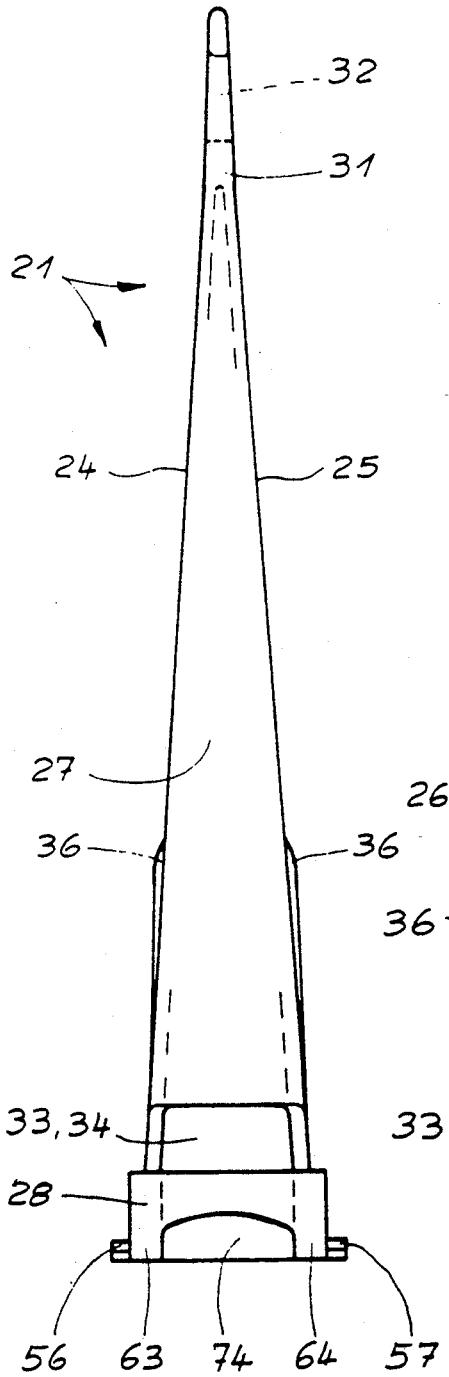
FIGS. 2 and 3 each show a side view of the signaling body according to FIG. 1 in two different viewing directions.

The two wall regions 24 and 25 on the wide side of the signaling body 21 are at least approximately flat in design. They are inclined toward each other in the upward direction, so that they have the greatest distance from each other at the foot 28 of the signaling body 21 and they approach each other at the upper end to such an extent that they finally touch each other (FIG. 2). The top longitudinal section 31 of the signaling body 21 is of a solid-wall design. In this longitudinal section 31 there is a gripping hole 32, by means of which the signaling body 21 can be grasped and lifted as well as handled in other ways.

The two wall regions 26 and 27 on the narrow side of the signaling body 21 are designed as sections of a slender conical shell, the horizontal projection of which represents at least approximately a semi-circular area. These conical shell-shaped wall regions 26 and 27 have a somewhat greater wall thickness than the two wall regions 24 and 25 on the wide side of the signaling body 21. As a result, the righting behavior of the signaling body 21 is improved, so that it rights itself again more quickly if it has been bent over by a vehicle wheel rolling over it.

Figure 3:
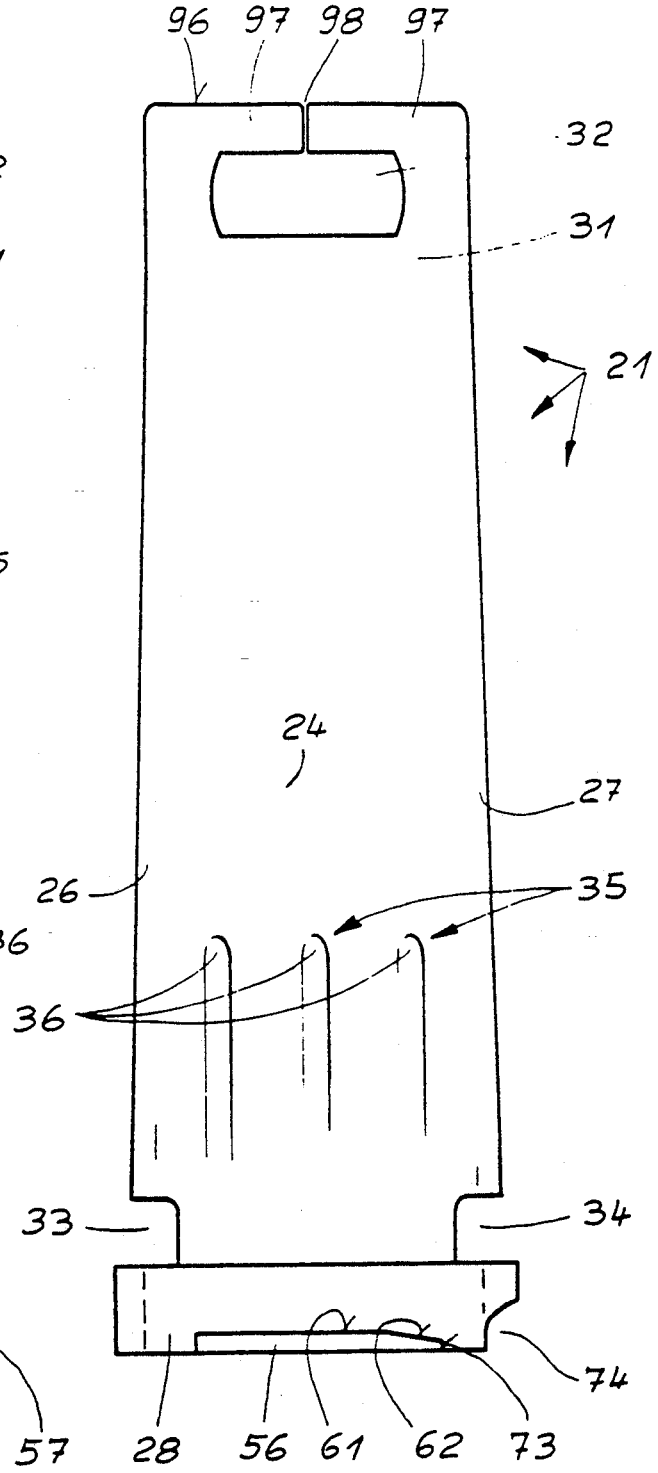

In order to improve the bending behavior of the signaling body 21, the two wall regions 26 and 27 on the narrow sides of the signaling body 21 each have a recess 33 and 34 respectively. These recesses 33 and 34 are located above the foot 28 at a level at which they are completely above the top of the base plate 22. The recesses 33 and 34 have a height which is somewhat less than the distance between the two flat wall regions 24 and 25. Each of the two recesses 33 and 34 extends in the circumferential direction at least approximately just as far as the curved wall region on the respective narrow side of the signaling body 21, i.e. from the one transitional point to the other transitional point with the subsequent flat body region 24 and 25 respectively of the wide side of the signaling body 21. As evident in particular from FIG. 3, the recesses 33 and 34 at the transitional point with the foot 28 are sharp-edged in design, whereas they are rounded-off at the transitional point with the curved wall region 26 and 27 respectively.

In the region of the signaling body 21 at a level above the recesses 33 and 34 there are a number of reinforcing elements 35 molded onto the wall regions 24 and 25 on the wide side of the signaling body 21. In the case of the embodiment of the signaling body 21 shown in FIGS. 2 and 3, said reinforcing elements are designed as ribs 36, which are molded onto the outside of the wall regions 24 and 25. They are vertically aligned. Their height is approximately one quarter of the overall height of the flat wall regions 24 and 25 without the foot 28. The ribs 36 are higher at their upper end and merge continuously at their lower end with the flat wall regions 24 and 25, because they have less of an inclination to the vertical than their two wall regions 24 and 25, although the backs of the ribs 36 have a certain inclination to the vertical of the order of magnitude of the usual draft angle.

In the case of the embodiment of the signaling body 21' shown in FIGS. 9 and 10, the reinforcing elements 35' have the form of sickle-shaped indentations 37 in the otherwise flat wall regions 24' and 25'. They are likewise vertically aligned.

In the case of the indentations 37, the greater depth is at the bottom, whereas they merge continuously in the upward direction with the flat but sloping wall region 24' and 25' respectively.

Due to the fact that the greater resistance to dimensional change of the reinforcing elements 35' designed as indentations 37 is in the region of their greater depth, their reinforcing effect is closer to the recesses 33 and 34 (FIG. 3) than is the case with the ribs 36. As a result, the bending behavior of the signaling body 21 in the region of the recesses 33 and 34 is enhanced even more. In addition, the bending behavior of the wall regions 24' and 25' in the region of the indentations 37 is better, because there is no wall thickness increase there, as is the case with the ribs 36.

The base plate 22 has a rectangular base area (FIG. 4), the width of which is about 160 mm and the length of which lies between 200 and 250 mm. It has a height of about 20 mm. The underside 38 of the base plate 22 is flat, at least in certain regions. When the base plate 22 is put to use, the flat, continuous regions of the underside 38 are provided with an adhesive, by means of which the base plate 22 is adhesively fixed to the ground at the place it is put to use.

The upper side 39 of the base plate 22 is likewise flat, at least in certain regions. This applies at least to the central part 41 of the base plate 22 (FIG. 5) and to the adjoining longitudinal sections 42 and 43. These two longitudinal sections 42 and 43 are each adjoined by a ramp section 44 and 45 respectively, at which the height of the base plates 22 decreases from its maximum value of about 20 mm at the central part 41 to a minimum value which it still has at the two edges 46 and 47 on its narrow sides.

Figure 5:
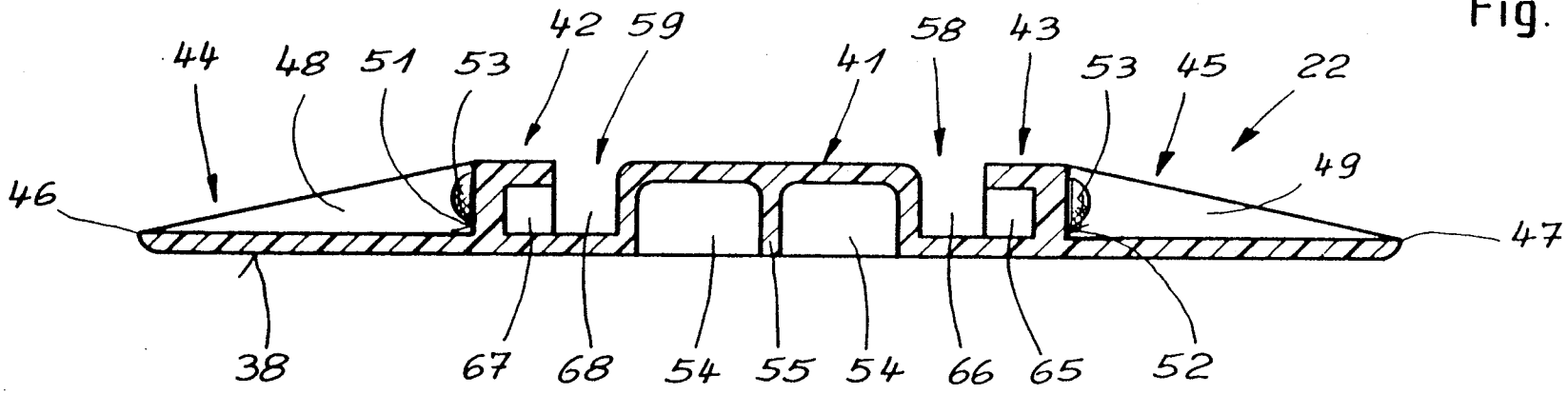
FIG. 5 shows a longitudinal section of the base plate.
Figure 6:
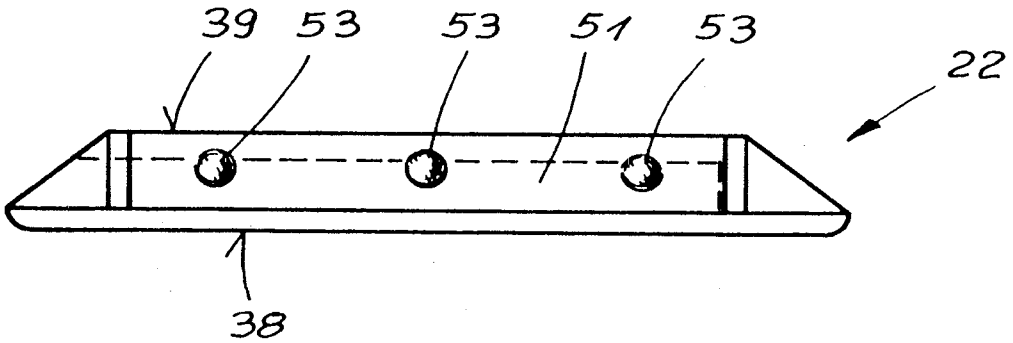
FIG. 6 shows a front view of the base plate.
Figure 7:
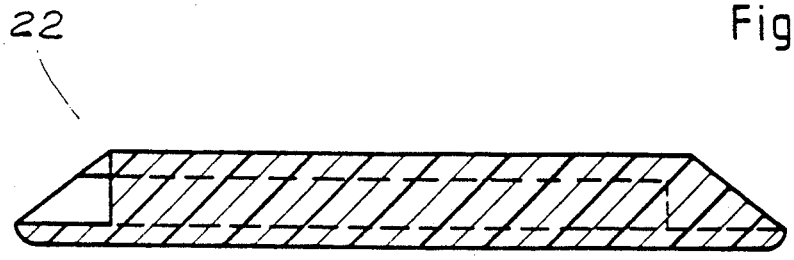
FIG. 7 shows a cross-section of the base plate taken along line A—A in FIG. 4.

As evident in particular from FIG. 5, the base plate 22 has in each of the ramp sections 44 and 45 a large-area recess 48 and 49 respectively, in the base area of which the base plate 22 has an at least approximately uniform wall thickness. In the longitudinal direction of the base plate 22, these recesses 48 and 49 each end at a relatively steeply aligned wall surface 51 and 52 respectively. On these wall surfaces 51 and 52 there are a number of circular recesses, into each of which a reflector 53 is inserted (FIG. 5 and FIG. 6).

Figure 8:
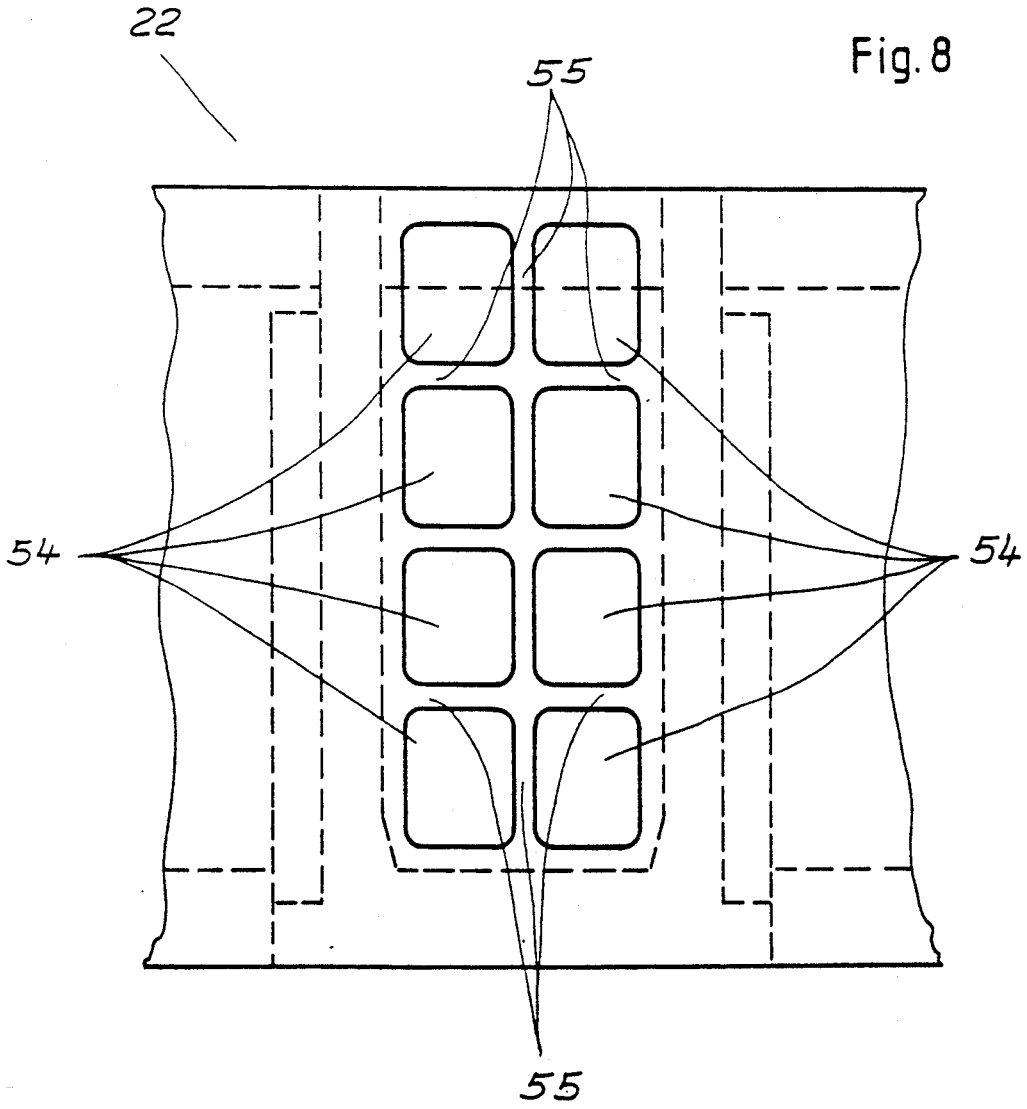
FIG. 8 shows a detail of a bottom view of the base plate.

The base plate 22 is provided in the base area of its central part 41 on the underside with a number of recesses 54 (FIG. 5 and FIG. 8), between which there are narrow wall parts 55 in the manner of reinforcing ribs. This avoids a sizeable continuous accumulation of material in the central part 41, which could lead to warping effects during shrinking of the material.

Figure 4:
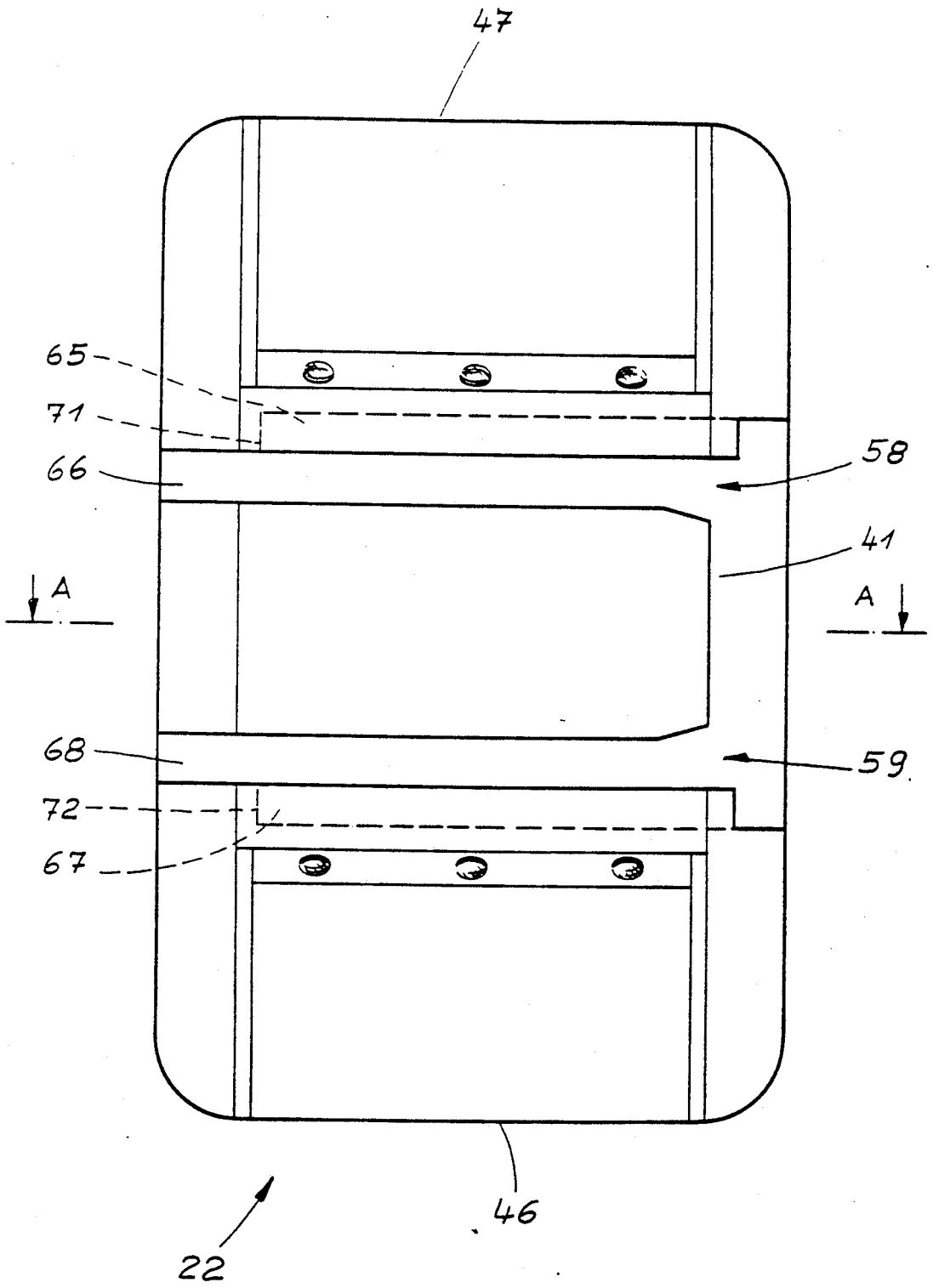
FIG. 4 shows a plan view of the base plate.

Belonging to the coupling device 23 there are two holding ribs 56 and 57 on the signaling body 21 (FIG. 2 and FIG. 3) as well as two grooves 58 and 59 on the base plate 22 (FIG. 4 and FIG. 5).

The two holding ribs 56 and 57 are molded-on on the outside to the foot 28 in the region of the two wide sides of the signaling body 21. The two holding ribs 56 and 57 have a rectangular cross-section. At their end located at the front in the direction of insertion which is represented on the right-hand side in FIG. 3, the holding ribs 56 and 57 have a ramp area 62, which is downwardly inclined from its upper side 61.

The holding ribs 56 and 57 and the adjoining wall part 63 and 64 respectively of the foot 28 have together in each case an L-shaped cross-sectional area (FIG. 2). Accordingly, the two grooves 58 and 59 on the base plate 22 likewise have an L-shaped cross-sectional area (FIG. 5). The groove 58 is made up of the two groove parts 65 and 66 and the groove 59 is made up of the two groove parts 67 and 68. Of these, the groove parts 65 and 67 are matched to the holding rib 56 and 57 respectively on the foot 28. The groove parts 66 and 68 are accordingly matched to the wall parts 63 and 64 respectively of the foot 28. This matching of the cross-sectional areas is expediently carried out in such a way that, taking into consideration the material elasticity in the case of the signaling body 21 and in the case of the base plate 22, there is a driving fit between these two parts.

In order that the signaling body 21 can automatically go into the correct operational position when fitted together with the base plate 22, wall parts 71 and 72 respectively (FIG. 4), which in each case terminates the respective groove part 65 and 67 at the end face, are provided on the base plate 22 for limiting the travel of the two holding ribs 56 and 57 on the foot 28 of the signaling body 21. These wall parts 71 and 72 consequently represent a stop for the holding ribs 56 and 57. They are therefore arranged on the base plate 22 at that point at which the end face 73 of the holding ribs 56 and 57 is located when the signaling body 21 assumes its operational position on the base plate 22.

Since the central part 41 of the base plate 22 is located in the paths of movement of the leading narrow side of the foot 28 when the signaling body 21 and the base plate 22 are fitted together, there is at this point of the foot 28 a recess 74, the vertical projection of which corresponds to the vertical projection of the central part 41. On the opposite narrow side, the wall surface of the foot 28 is not interrupted.

As can be seen in particular from FIG. 2, the foot 28 has a greater wall thickness all around than the remaining part of the signaling body 21. The reason for this is that at least the lower part of the foot 28 forms together with the holding ribs 56 and 57 a part of the coupling device 23 between the signaling body 21 and the base plate 22, and it must therefore have a higher resistance to deformation than the remaining part of the signaling body 21, which is intended to have a particularly great elastic deformability especially in the region on a level with the recesses 33 and 34 on its two narrow sides. A satisfactory bending-over of the signaling body 21 and a re-righting of the signaling body 21 which is just as complete as it is quick is more likely to be achieved the more the foot 28 and the holding ribs 26 and 27 molded onto it retain their shape and consequently their firm fit in the grooves 58 and 59 of the base plate 23.

Figure 11:
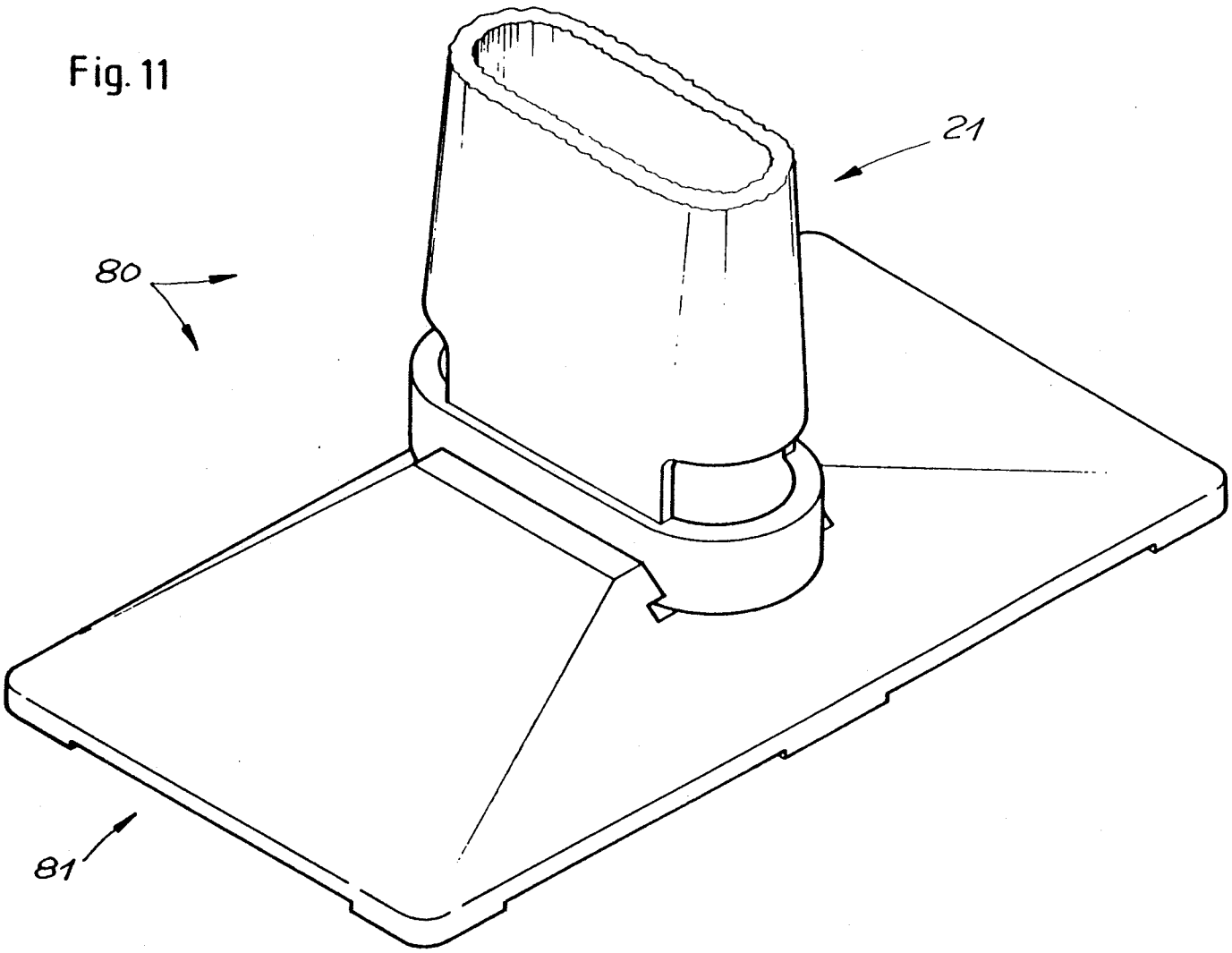
FIG. 11 shows a detail of a perspective view of the signaling device with a foot plate.

In the case of the signaling device 80 shown in FIG. 11, a signaling body 21 as explained above has been used. It is coupled to a foot plate 81, which is generally placed freely on the ground at the place where the signaling device 80 is put to use.

The foot plate 81 has a rectangular shape in base outline. It has a length of about 500 mm and a width of about 250 mm. Its upper side is shaped similarly to a truncated pyramid, the side surfaces of which are inclined nearly horizontally. In their center there is an approximately flat terminating area, which lies about 70 mm above the ground.

Figure 12:
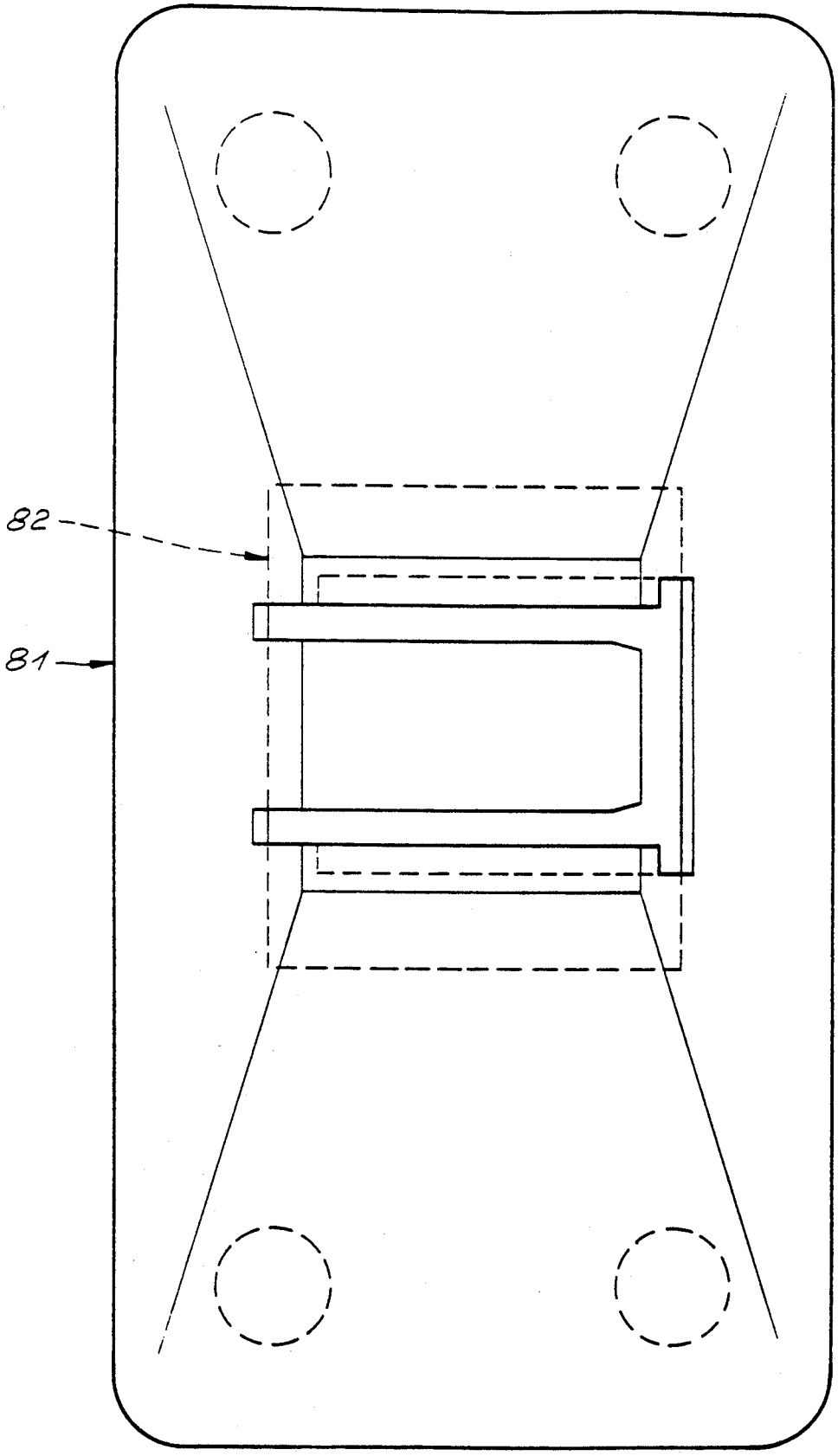
FIG. 12 shows a plan view of the foot plate.
Figure 13:
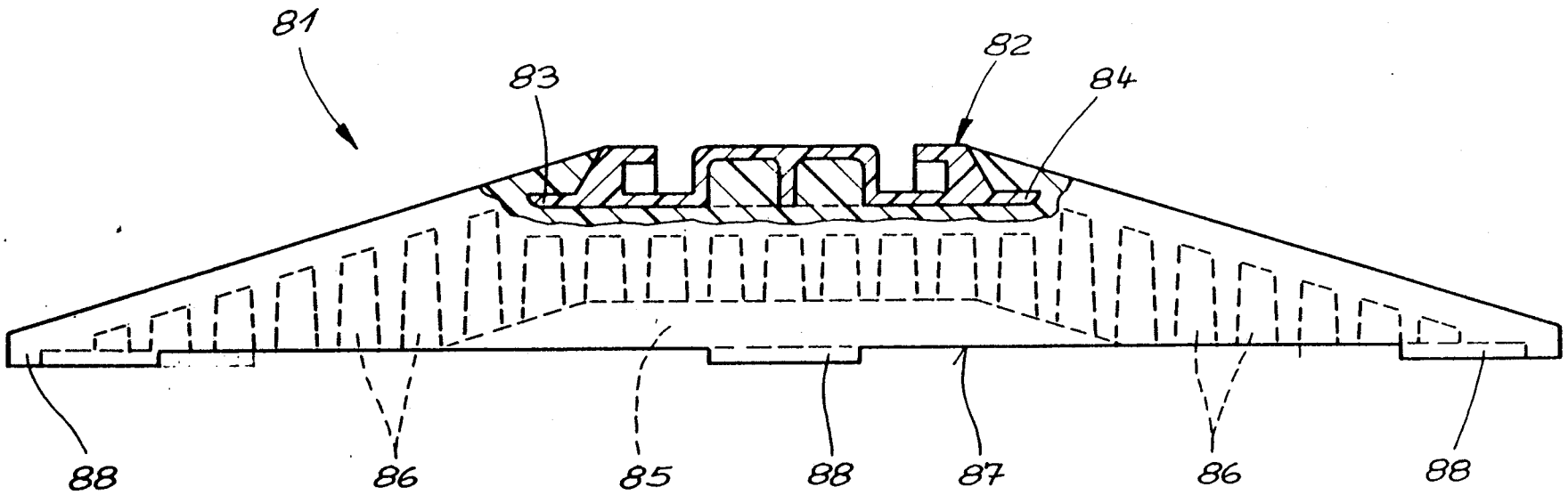
FIG. 13 shows a partially sectional side view of the foot plate.
Figure 14:
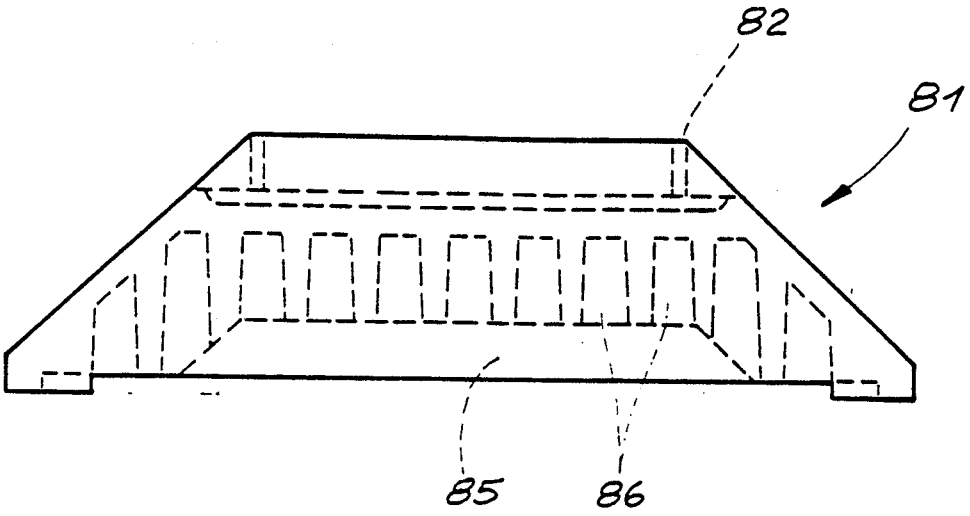
FIG. 14 shows a front view of the foot plate.

As can be seen from FIGS. 12 to 14, there is molded into the upper part of the foot plate 81 a plate which is of an essentially identical or at least similar design to the base plate 22 and is referred to hereinafter as holding plate 82. As can be seen from FIG. 13, the holding plate 82 differs from the foot plate 22 only in that the ramp sections 44 and 45 existing there are shortened to two short base parts 83 and 84, and in that no reflectors are fitted to the steeply rising transitional area from these base parts 83 and 84 to the central longitudinal section of the holding plate 82, because this part of the holding plate 82 is also embedded in the material of the remaining part of the foot plate 81. Since the holding plate 82 is otherwise identical to the base plate 22, reference is made to the explanation of the latter.

By using the finished holding plate 82 on which all the parts of the coupling device 23 are present, the shape for the foot plate 81 as a whole can be kept more simple. In addition, this makes it possible to use different materials for the holding plate 82 and for the remaining part of the foot plate. It is quite possible to use recycled plastic scrap, so-called recycling plastic for the foot plate, as a result of which the costs for the foot plate 81 can be reduced very considerably overall, without impairing the functional capability of the coupling device 23.

The foot plate 81 is provided on its underside with a recess 85, which is designed as a nesting shape for the top of the foot plate 81 located in the same region in horizontal projection, so that the recess 85 can serve as a stacking hollow. As a result, several foot plates 81 can be stacked one on top of the other, holding one another in the correct parallel alignment in relation to one another.

Along with the stacking hollow 85, there are on the underside of foot plate 81 a whole series of other recesses 86, which are all aligned vertically, and the wall surfaces of which are arranged inclined with a draft sufficient for the material used. With these recesses 86, sizeable accumulations of material inside the foot plate 81 are avoided.

The foot plate 81 has on its underside an essentially flat base area 87. In the region of the corners and in the longitudinal center of the foot plate 81 there are foot cleats 88 molded-on, by which the foot plate 81 rests on the ground. As a result, the base area 87 is spaced a certain distance from the ground, so that for example rain water flowing onto the base plate can flow underneath it and does not have to flow around it.

Figure 15:
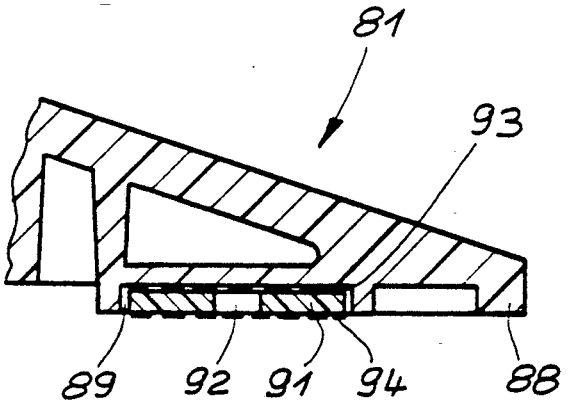
FIG. 15 shows a detail of a vertical section of the foot plate.
Figure 16:
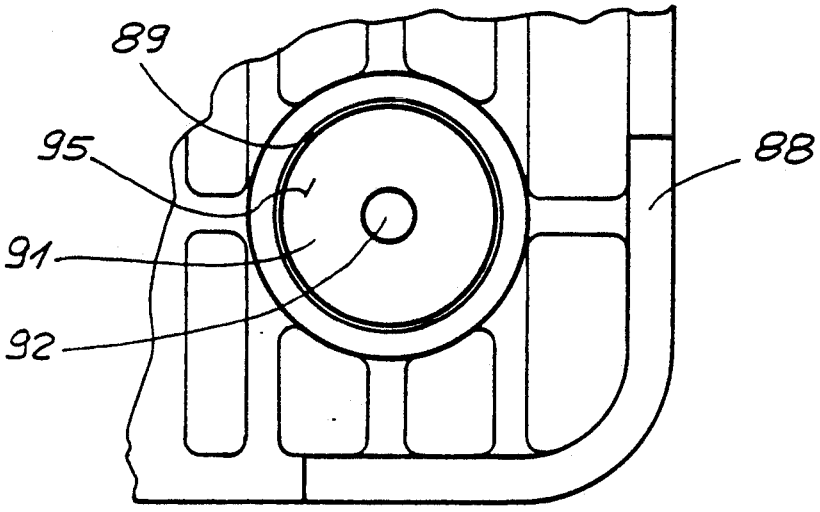
FIG. 16 shows a detail of a bottom view of the foot plate.

As can be seen from FIGS. 15 and 16, there are flat recesses 89 of circular configuration on the underside of the foot plate 81. In each of these recesses 89 there is inserted an adhesive platelet 91, the thickness of which is somewhat greater than the depth of the recesses 89. The adhesive platelets 91 have an annular shape, i.e. they have a circular through-hole 92 in their center.

The adhesive platelets are provided on each of their two flat sides with a respective adhesive layer 93 and 94, which are indicated in FIG. 15 as dashed lines. The adhesive on the upper side of the adhesive platelet 91 is chosen such that it produces a good adhesive effect with the material of the foot plate 81 present in the region of the recesses 91. The adhesive on the underside of the adhesive platelets 91 is chosen such that it produces a good adhesive effect with the ground at the place where the foot plate 81 is put to use. Both the adhesive layers 93 and 94 are expediently covered by a protective foil as long as the adhesive platelets 91 are still loose. Before adhesively attaching a platelet in one of the recesses 89, the protective foil is pulled off the upper adhesive layer 93 and the adhesive platelet is adhesively fixed into the recess 89. The protective foil on the lower adhesive layer 94 remains in place until the precise place where the individual foot plate 81 is to be set up is established. Then the foot plate can be tilted onto the side, expediently with the signaling body 21 already fitted, the protective foil can be removed from the lower adhesive layer 94, and the entire signaling device 80 can be righted and the foot plate 81 pressed firmly onto the ground.

When the foot plate 81 is later removed from the place where it is set up, the possibility cannot be ruled out that part of the lower adhesive layer 94 becomes detached from the adhesive platelet 91 and remains stuck on the ground, or that this adhesive layer 94 loses some of its adhesive effect due to attached dirt or loose parts of the ground. Then a simple tool, for instance a screwdriver, can be inserted into the through-hole 92, and with its aid the adhesive platelet 91 can be pried out of the recess 89 and, if need be, even broken out. Wherever necessary, the recess 89 can be cleaned of remains of the upper adhesive layer 93 left behind and subsequently a new adhesive platelet 91 inserted again.

In the event that an additional adhesive effect by the adhesive platelets 91 is not necessary or not desired, the adhesive platelets 91 may also be omitted. Then, the foot plate 81 rests on its foot cleats 88 and on the circular beads 95, which enclose the recesses 89 on the outside and have at least approximately the same height as the foot cleats 88.

On the signaling body 21, the gripping hole 32 is arranged in the top longitudinal section 31 of solid-wall design. The part of this longitudinal section 31 located between the gripping hole 32 and the crest 96 of the signaling body 21 (FIG. 1) serves as a gripping strip 97 for the signaling body 21. The signaling body 21 can be comfortably grasped with the hand by this and transported. If the signaling body 21 is united with a holding device in the form of a base plate or a foot plate which has relatively small dimensions and a relatively low weight, it is even possible by means of the gripping strip 97 for the entire signaling device to be grasped by hand and moved to a different place. However, in order that the gripping hole 32 and the gripping strip 97 do not give rise to the risk that a vehicle driving over it becomes hooked on the gripping strip by downwardly projecting parts on its underside, it is advantageous to divide the gripping strip 97 in the center by a slit 98. Then the two mutually separate sections of the gripping strip 97 can independently move out of the way to the side and immediately release again a vehicle part brushing against it. Since both sections of the gripping strip 97 are grasped at the same time when the signaling body 21 is carried, the slit 88 does not impair the function as a carrying strip.

Figure 17:
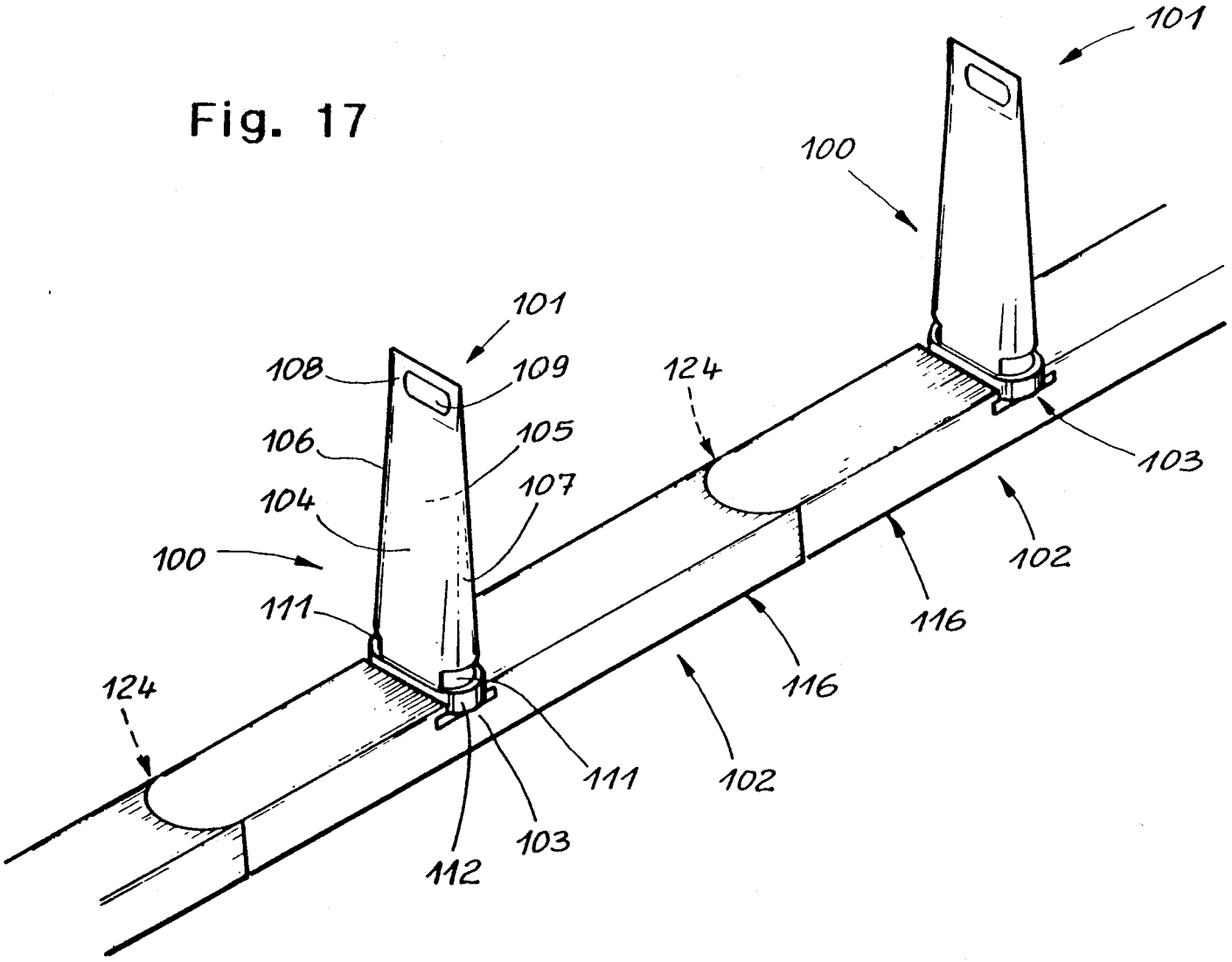
FIG. 17 shows a perspective detail of a group of signaling devices according to the invention with signaling body and foot bearing bar.

The signaling devices 100 evident from FIG. 17 each have a cone or horn-shaped signaling body 101 and each have a foot bearing bar 102. These two parts can be joined together by means of a coupling device 103 to form the signaling device 100 and, if need be, can also be separated again from each other.

The signaling body 101 is identical in design to the signaling body 21. Wherever details of the signaling body 101 are not separately explained in the following, the explanation of the signaling body 21 applies at least analogously. At the same time, the reference numerals of some of the details of the signaling body 101 are to be taken as increased by the number 80 with respect to those of the signaling body 21. The gripping hole 109 is arranged in the upper solid longitudinal section 108. The wall regions 106 and 107 are each interrupted by a recess 111.

Figure 18:
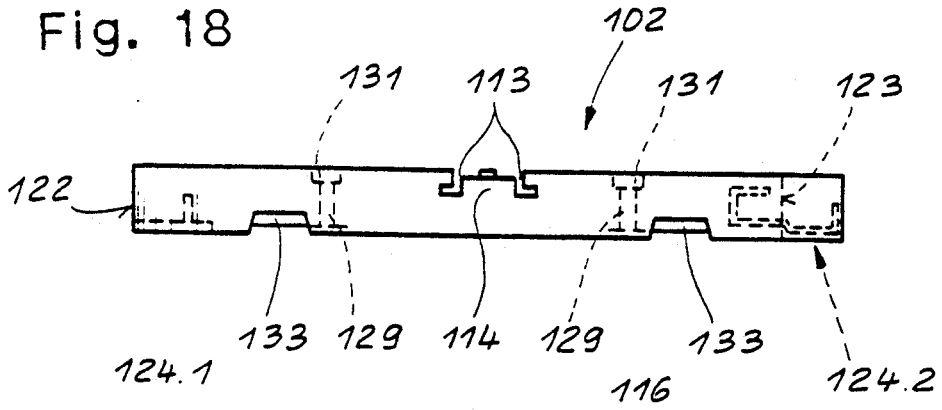
FIG. 18 shows a side view of one of the foot bearing bars according to FIG. 17.

The foot 112 adjoins at the lower end of the wall regions 104 and 105 of the wide sides of the basic body 101. Molded onto said foot on both its wide sides in the region of its lower edge are the outwardly projecting holding ribs, by which the foot is given its L-shaped cross-section on the longitudinal sides. Two transversely extending grooves 113 are molded into the top of foot bearing bar 102 (FIG. 18 and FIG. 19), the cross-section of which grooves corresponds to the cross-section of the foot 112. Between the two grooves 113 there is a central part 114 of the foot bearing bar 102, which has approximately the same height as the remaining parts of the top of the foot bearing bar 102. This central part 114 consequently forms a type of guide rib between the two grooves 113, which it delimits from each other. The inside surfaces of the foot 112 bear against the spaced outer side walls of the central part 114 when said foot is pushed into the grooves 113. As a result, an additional holding effect comes into play, which prevents a force acting in the longitudinal direction of the foot bearing bar 102 on the signaling body 101 from tearing the signaling body out of the grooves 113.

Figure 19:
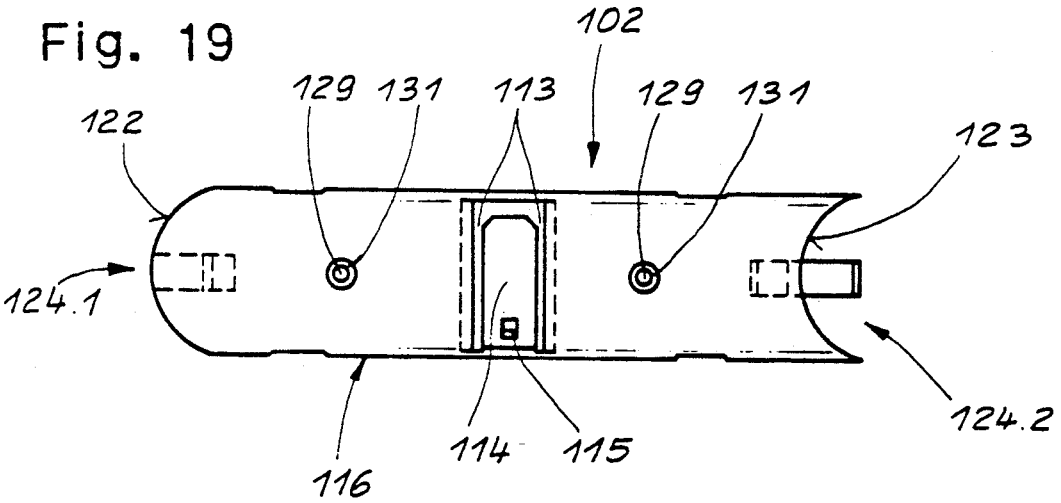
FIG. 19 shows a plan view of the foot bearing bar according to FIG. 18.

In the transverse direction, the signaling body 101 is held firmly on the foot bearing bar 102 in particular by providing close tolerances for the dimensions of the sections of the foot 112 and of the holding ribs fastened thereto acting as parts of the coupling device 103, on the one hand, and of the grooves 113 and the central part 114. An additional retaining safeguard is provided by a holding nose 115, which is arranged on the central part 114 at the point (FIG. 18 and FIG. 19) at which the narrow side of the foot 112 at the front in the direction of insertion is located when the signaling body 101 is pushed onto the foot bearing bar 102. The back of holding nose 115, which rises in the shape of a ram, is located on that side of the holding nose 115 which is directed oppositely to the direction of insertion of the signaling body 101. The back of the holding nose catches an edge of the signaling body after the signaling body has been slide over the nose, As can be seen in particular from FIG. 18 and FIG. 19, the foot bearing bar 102 has an at least approximately right-parallelepipedal basic body 116. It is a plastic molding and is generally produced from recycling plastic. The length of the basic body 116 is at least 1 m. Its height lies between 70 and 100 mm and is preferably 90 mm. Its width lies between 200 and 260 mm and on the underside 117 is preferably 230 mm. On the top 118, the width is preferably 190 mm. For the two side walls 119 and 121, this produces an angle of inclination with respect to the vertical of at least approximately 12.5°. As evident from FIG. 18, the two end faces 122 and 123 are aligned at least approximately vertically. As can be seen in particular from FIG. 19, these two end faces are curved in base outline in the shape of a circular arc. To be precise, the end face 122 on the left in FIG. 19 is convexly curved and the end face 123 on the right in FIG. 19 is concavely curved. The radius of curvature of the two end faces is at least approximately identical, so that they fit closely one into the other.

The basic bodies 116 are equipped with a coupling device 124, by means of which each foot bearing bar 102 can be coupled in its longitudinal direction in an interlocking manner with a neighboring longitudinal bearing bar and can be uncoupled from it again.

The parts of the coupling device 124 are divided on a foot bearing bar 102 into two groups, of which the one group of parts 124.1 is arranged at the one end region with the convexly curved end face 122 and of which the second group of parts 124.2 is arranged in the end region of the basic body 116 with the concavely curved end face 123 (FIG. 19 as well as FIG. 21 to FIG. 24).

The group of parts 124.2 includes a vertically upwardly directed coupling element 125, which is arranged at the end of a holding clip 126. The holding clip 126 is designed as a bar steel section, one end section of which is angled at right angles to form the coupling element 125. At the opposite end of the holding clip 126, the bar steel section is bent twice, in order to form a hook-shaped end. The part of the holding clip 126 protruding from the basic body 116 lies only a little above the underside 117 of the basic body 116. The longitudinal section of the holding clip 126 remote from the coupling element 125 is offset somewhat in relation to the longitudinal section adjoining the coupling element 125, so that the former longitudinal section remote from the coupling element, together with the adjoining hook-shaped end, is located fully in the region of vertical projection of the basic body 116 and is consequently molded into the basic body during the production of the basic body.

The coupling element 125 should lie as far as possible at the center of curvature of the concavely curved end face 123. Moreover, however, as far as possible the coupling element should not lie outside the enveloping figure of the basic body 116, that is to say the coupling element should not project in the axial direction beyond the end of the basic body 116.

The group of parts 124.1 includes a vertically upwardly directed recess 127 on the underside 117 of the basic body 116. It also includes a groove 128 on the underside 117. Just like the coupling element 125, the recess 127 has a rectangular base area, which is only slightly larger than the base area of the coupling element such that a mutual turning movement between the two parts of up to 1° about the vertical axis is possible. The recess 127 has at least approximately the same spacing from the convexly curved end face 122 as the coupling element 125 has from the concavely curved end face 123.

The groove 128 corresponds to the shape of the holding clip 126, so that there is room for the complete holding clip 126 in it. In this arrangement, the base area of the groove 128 is slightly larger than the base area of the holding clip 126 such that a mutual swiveling movement between these two parts of up to 1° about the axis of the coupling element 125 is possible.

In the basic body 116 there are formed in its plane of symmetry two vertically aligned through-holes 129. At the upper end of each at the through-holes 129 there is a cylindrical recess 131. If need be, bottom screws in the form of head screws can be inserted in the through-holes 129 and screwed into holes in the roadway, the head of the screw coming to bear against the axial end face of the recess 131. Such an additional fastening of the foot bearing bars 102 is advantageously used whenever the complete signaling device is to remain in place for a prolonged period and it is desired to avoid absolutely any slipping of the foot bearing bars, even by small amounts, during this prolonged period.

Figure 21:
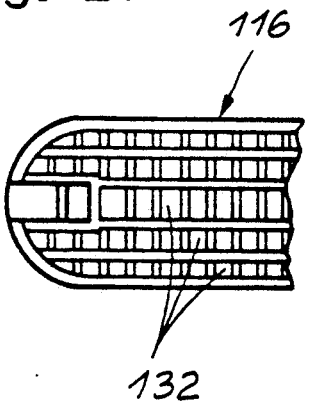
FIG. 21 shows a detail of a bottom view of the foot bearing bar according to FIGS. 18 and 19.
Figure 20:
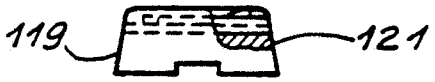
FIG. 20 shows a partially sectional front view of the foot bearing bar according to FIGS. 18 and 19.

As can be seen from FIG. 21, the basic body 116 is provided on its underside with a considerable number of recesses 132, predominantly with a rectangular base area, in order that the total weight of the foot bearing bar 102 remains within a certain limit, which could be exceeded, depending on the material used for the basic body 116, if the basic body 116 with the given dimensions were made solid.

Molded onto the lower edge of the side walls 119 and 121 there are in each case two recesses 133, which serve as gripping holes when the foot bearing bar 102 rests evenly on the ground. Then it is possible to reach underneath the edge from both sides and lift the foot bearing bar 102.

Figure 26:
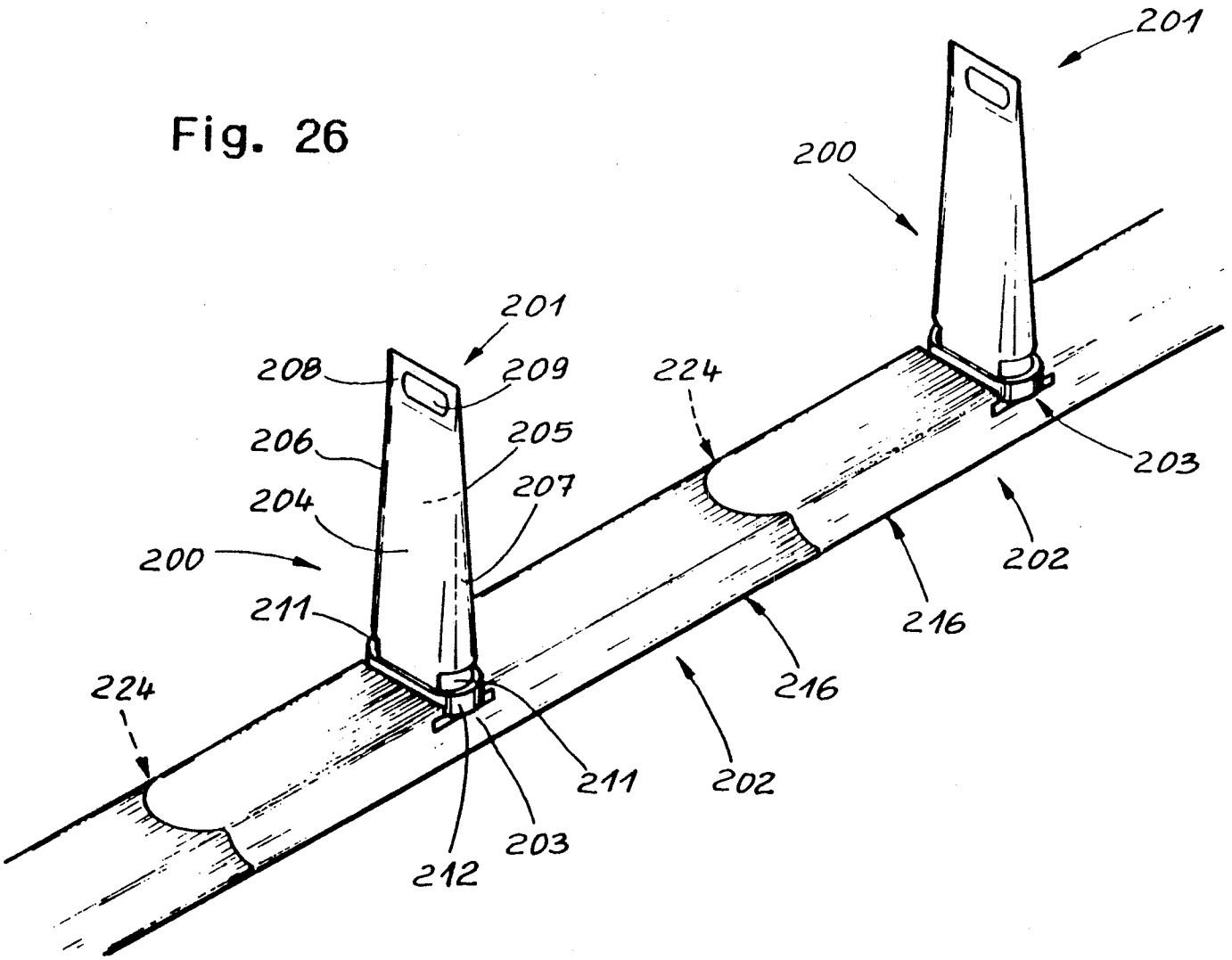
FIG. 26 shows a perspective detail of a group of signaling devices according to the invention with signaling body and modified foot bearing bar.

The signaling devices 200 shown in FIG. 26 each have a cone or horn-shaped signaling body 201 and each have a foot bearing bar 202. These two parts can be joined together by means of a coupling device 203 to form the signaling device 200 and, if need be, can also be separated from each other again.

The signaling body 201 is in identical design to the signaling body 101, to the explanation of which reference is made, where the reference numerals of the signaling body 201 are to be taken as increased by the number 100 with respect to those of the signaling body 101. The same applies to the details of the foot bearing bar 202 which interacts with the signaling body 201.

Figure 27:
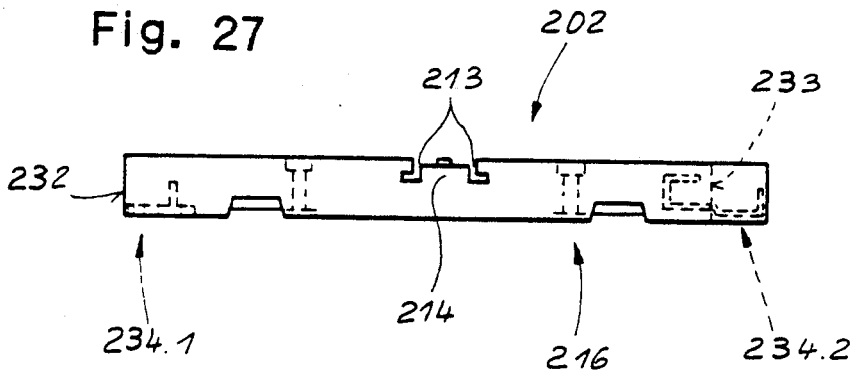
FIG. 27 shows a side view of one of the foot bearing bars according to FIG. 26.
Figure 28:
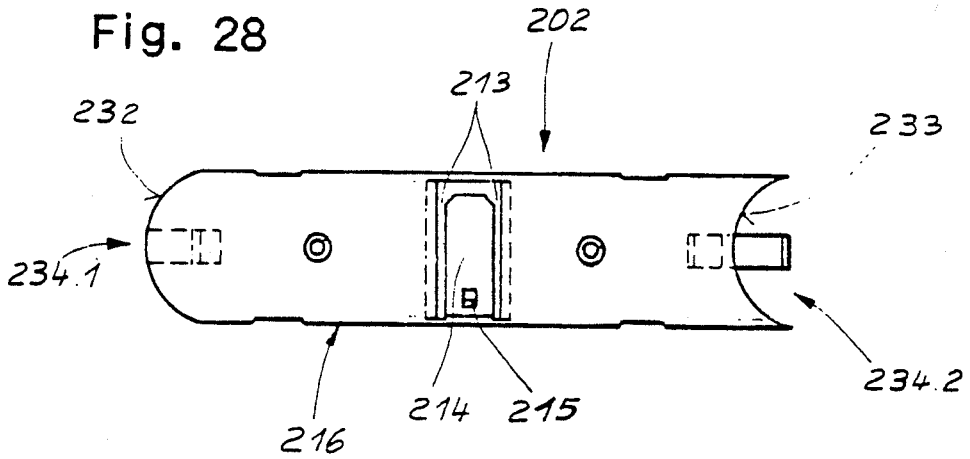
FIG. 28 shows a plan view of the foot bearing bar according to FIG. 27.
Figure 29:
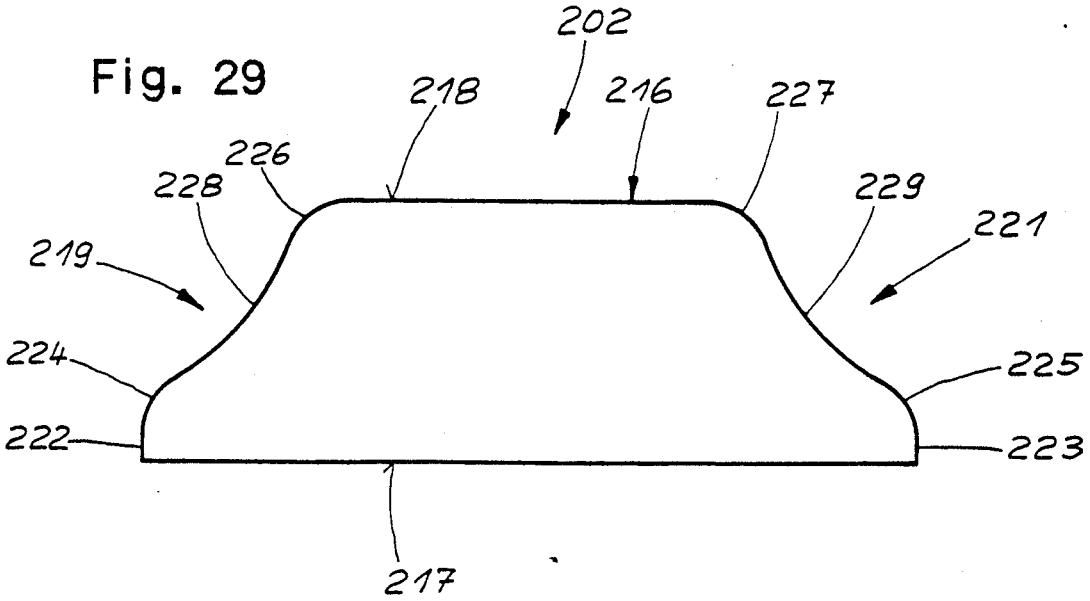
FIG. 29 shows a front view of the foot bearing bar according to FIGS. 27 and 28.

As can be seen in particular from FIG. 27 and FIG. 28, the foot bearing bar 202 has an approximately right-parallelepipedal or at least prismatic basic body 216. It is a plastic molding and is generally produced from recycling plastic. The length of the basic body 216 is at least 1 m. Its height lies between 70 and 100 mm and is preferably 80 mm. Its width lies between 200 and 260 mm and on the underside 217 is preferably 240 mm. The width is distinctly less on the top 218 and is preferably 130 mm.

The two side walls 219 and 221 running in the longitudinal direction have several wall sections of different shape and different course The underside 217 is adjoined by an at least approximately vertically aligned wall section 222 and 223 respectively, the height of which lies between 15 and 25 mm and is preferably 20 mm. This wall section 222 and 223 is adjoined in each case by a transitional region 224 and 225 respectively, which is curved convexly in cross-section. Its radius of curvature is at least approximately 20 mm. The top 218 is likewise adjoined in each case by a transitional region 226 and 227 respectively, which is convexly curved in cross-section. The radius of curvature of transitional regions 226 and 227 is also at least approximately 20 mm. Between the two transitional regions of a side, 224 and 226 on the one hand and 225 and 227 on the other hand, there is in each case a large wall section 228 and 229 respectively, which is curved concavely in cross-section. Owing to the predetermined dimensions of the other parts of the cross-sectional shape of the foot bearing bar 202, its radius of curvature is at least approximately 78 mm, in order that a continuous transition from one surface or wall section into the next is ensured. This concavely curved wall section 228 or 229 forms together with the transitional region 224 or 225 respectively adjacent its lower end, a type of foot bed for a vehicle wheel which rolls obliquely onto the foot bearing bar 202. This applies in particular whenever the angle of approach is very small. Then the vehicle wheel runs onto this foot bed without difficulty. If the vehicle wheel continues to roll at this angle of approach, the concave wall section 228 or 229 and the transitional region 226 or 227 respectively adjoining it at the top acts like a type of ramp, which allows the vehicle wheel to roll over the foot bearing bar 202 without major bumping.

As can be seen from FIG. 27, the two end faces 232 and 233 are aligned at least approximately vertically. As shown in particular in FIG. 28, these two end faces are curved in base outline in the shape of a circular arc. To be precise, the end face 232 on the left in FIG. 28 is convexly curved and the end face 233 on the right in FIG. 28 is concavely curved. The radius of curvature of the two end faces is at least approximately identical, so that they fit closely one into the other.

The basic bodies 216 are equipped with a coupling device 234, by means of which each foot bearing bar 202 can be coupled in its longitudinal direction in an interlocking manner with a neighboring longitudinal bearing bar and can be uncoupled from it again.

The parts of the coupling device 234 are divided on a foot bearing bar 202 into two groups, of which the one group of parts 234.1 is arranged at the one end region with the convexly curved end face 232 and of which the second group of parts 234.2 is arranged in the end region of the basic body 216 with the concavely curved end face 233 (FIG. 28).

Figure 30:
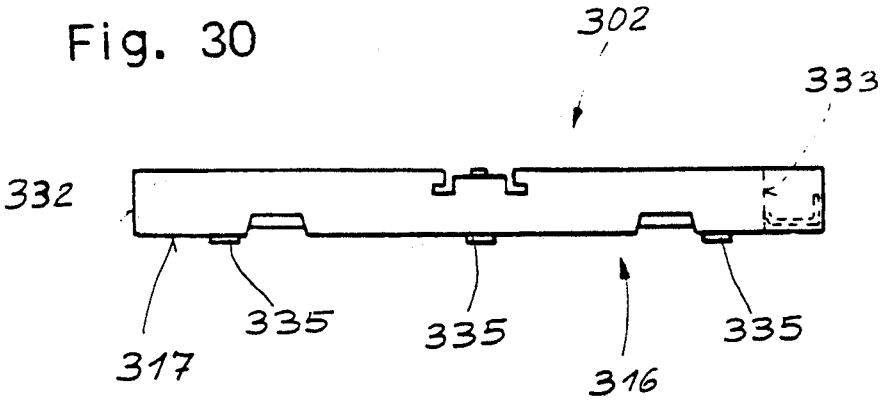
FIG. 30 shows a side view of a foot bearing bar with a further modification.
Figure 31:
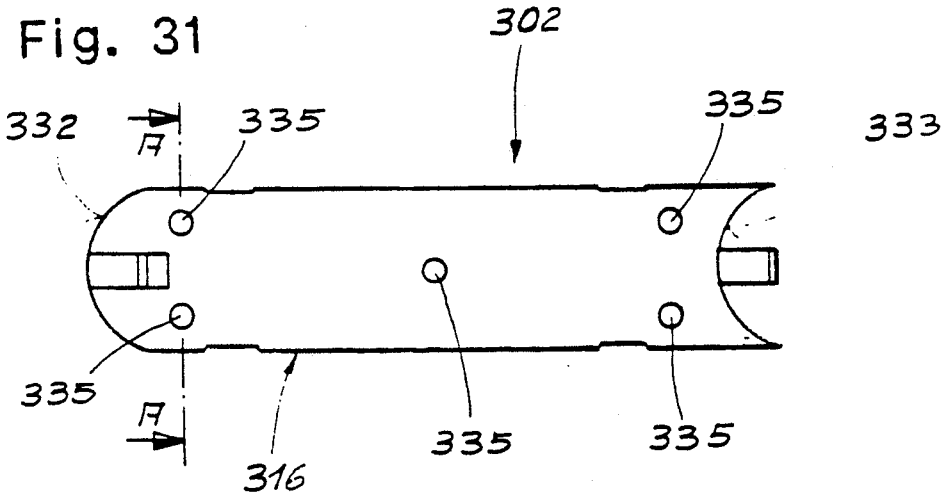
FIG. 31 shows a bottom view of the foot bearing bar according to FIG. 30.
Figure 32:
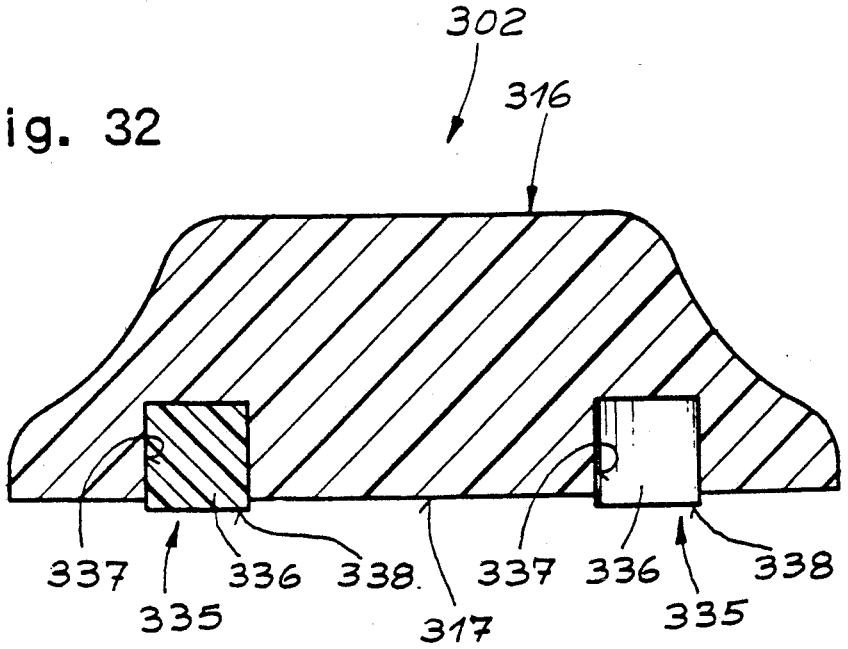
FIG. 32 shows an enlarged cross-section of the foot bearing bar taken along line A—A in FIG. 31.

In the following, a modification of the signaling device 201, which only affects its foot bearing bar, is explained with reference to FIGS. 30 to 32. Wherever details of the foot bearing bar 302 are not explained separately in the following, the explanations regarding the foot bearing bar 202 according to FIGS. 26 to 29 apply, where the reference numerals of the foot bearing bar 302 are to be taken as increased by the number 100 with respect to those of the foot bearing bar 202.

With an otherwise identical outer shape of the foot bearing bar 302 in comparison with the foot bearing bar 202, for instance in the region of the end faces 332 and 333, the basic body 316 of the foot bearing bar 302 has a plurality of foot knobs 335 on its underside 317. As shown in FIGS. 30 and 31, these foot knobs 335 are arranged in pairs in the region of the end sections of the basic body 316, to be precise symmetrically to the longitudinal center line of the basic body 316. A single foot knob 335 is arranged in the center of the basic body 316. However, the foot knobs may likewise be arranged there in pairs symmetrically to the longitudinal center line of the basic body 316. In addition, further foot knobs may also be arranged, for instance in the now knob-free surface areas of the underside.

The foot knobs 335 protrude downward about 3 mm beyond the underside 317 of the basic body 316, so that the foot bearing bar 302 generally rests only on the foot knobs 335 when in use, at least on paved roads and areas.

Unlike the adhesive platelets 91 in the relatively low corner regions of the foot plate 81 (FIGS. 15 and 16), the foot knobs 335 are formed by a circular-cylindrical insert 336, which is arranged in a likewise circular-cylindrical recess 337 on the underside 317 of the basic body 316. The height of the insert 336 is at least approximately 30 mm. Its diameter is likewise at least approximately 30 mm. The height of the insert 336 exceeds the depth of the recess 337 by the oversize, of at least approximately 3 mm, so that the foot knobs 335 then protrude downward from the underside 317.

The inserts 336 are held firmly in the recesses 337 most simply by the inserts 336 being produced at least in individual regions of their circumference with a slight oversize of the radius in comparison with the radius of the recesses 337. In addition, the inserts may, however, also be held firmly in the recesses 337 by means of an adhesive, it being expedient if the adhesive coating is only applied between the end faces of the inserts 336 and the bottom of the recesses 337, because any remains of adhesive left behind can be removed more easily there if a replacement of the insert becomes necessary, or else can be accepted more readily than on the circumferential surfaces of the inserts 336 and the recesses 337.

The foot knobs 335 serve primarily to increase the security against slipping of the foot bearing bar 302 or, in other words, to increase the resistance to displacement of the foot bearing bar 302 if lateral displacement forces occur. In addition, the stability of the signaling device is also improved, because its ground contact is concentrated on just a few surface areas. Apart from the fact that the concentration of the weight of the entire signaling device on the standing areas 338 of the foot knobs 335 has the effect of greatly increasing the surface loading between the standing area 338 and the ground at the place where the signaling device is placed for use, the security against slipping is also enhanced by the foot knobs 335, i.e. most simply the entire inserts 336, being produced from a material which is softer than the material of the basic body 336. A possible material for this is a material which is compacted and consolidated by a compression molding process from a granule-like base material with or without additional binder. The Shore hardness of this material advantageously lies between 60 and 65. Since with such a material the granule-like basic structure of the starting material results in the formation of a sandpaper-like surface, the standing areas 338 of the foot knobs 335 are given a surface structure which is very similar to that of road surfaces of asphalt or concrete or related materials. As a result, a certain interlocking is produced in addition to the frictional connection due to the normal forces of friction. The same effect is achieved if the inserts 335 are produced from a homogeneous rubber or plastic which has on the one hand a great tear strength and on the other hand an only low dimensional stability, which in other words is elastically very compliant and at the same time very tough. Owing to the low dimensional stability, even with a smooth standing area 338, the material can force itself into the unevennesses of the road surfaces, so that an additional interlocking is likewise achieved here. The high tear strength of the material prevents the surface areas of the foot knobs 335 which have elastically penetrated into the unevennesses of the road surface being sheared off if lateral forces, i.e. shearing forces, are applied to them.

I claim:

1. A signaling device comprising:

a hollow signaling body of resilient molded plastic material having a base with an elongated cross sectional configuration with substantially flat sidewall portions and rounded endwall portions;

a holding device at the base of said signaling device adapted to be placed upon an underlying surface for holding said signaling body in generally upright position, said holding device comprising a plate member; and coupling means for connecting said signaling body to said holding device, said coupling device comprising enlarged portions extending along said flat sidewall portions at the base of said signaling body and mating grooves in said plate member for receiving said enlarged portions, said grooves being open at one end so that said enlarged portions can be slid therein to secure said signaling body to said holding device; and wherein cutouts of sufficient height are formed in said endwall portions adjacent the base of said signaling body above the level of said holding device, said cutouts being of sufficient size that if said signaling body is struck by a vehicle, said flat sidewall portions can bend smoothly to tip said signaling body without crimping, and when said vehicle is no longer in contact with said signaling body, restoring forces of said resilient plastic material of said sidewall portions with return said signaling body to the upright position.

2. A signaling device according to claim 1, wherein said signaling body tapers upwardly to a solid top having substantially flat sides.

3. A signaling device according to claim 1, wherein said plate member comprises a central portion between said grooves, and the base of said signaling body is provided with a mating recess which receives said central portion of said plate when said enlarged portions are slid into said grooves.

4. A signaling device according to claim 1, wherein said endwall portions of said signaling body have a substantially semicircular horizontal cross-sectional configuration.

5. A signaling device according to claim 1, wherein said signaling body comprises a rigid circumferential foot portion, and said enlarged portions comprise horizontal ribs formed on flat sidewall outer surfaces of said foot portion.

6. A signaling device according to claim 1, wherein said plate member comprises a holding plate of rigid material embedded in a molded foot plate of plastic material.

7. A signaling device according to claim 1, wherein said enlarged portions and said grooves are dimensioned such that a driving fit exists between them.

8. A signaling device according to claim 1, wherein said plate member further comprises a stop at an end of at least one of said grooves for limiting the travel of the respective enlarged portion when said enlarged portion is slid into said groove, whereby said signaling body is retained in a desired position.

9. A signaling device according to claim 1, wherein leading ends of said enlarged portions which are slid into said grooves are provided with ramp portions for facilitating insertion of said enlarged portions into said grooves.

10. A signaling device according to claim 5, wherein said circumferential foot portion has a greater thickness than the remaining portions of said signaling body.

11. A signaling device according to claim 1, wherein reinforcing elements are provided in said flat sidewall portions of said signaling body above the level of said cutouts, said reinforcing elements being selected from the group consisting of vertically aligned, outwardly projecting ribs and vertically aligned indentations.

12. A signaling device according to claim 3, wherein said central portion of said plate member between said grooves corresponds in height to lateral portions of said plate member on opposite sides of said grooves.

13. A signaling device according to claim 1, wherein a plurality recesses having a predetermined depth are provided on the bottom of said holding device, and an adhesive platelet is inserted in each recess, each platelet having a thickness greater than the depth of the recess in which it is inserted and having an upper layer of adhesive which adheres to said holding device and a lower layer of adhesive capable of adhering to an underlying paved surface.

14. A signaling device according to claim 1 wherein said holding device is a foot bearing bar having an at least approximately right parallelipipedal body with a length of at least one meter, a height in the range from 70 to 100 mm, a width in the range from 200 to 260 mm, longitudinal sidewalls inclined inwardly toward a top at an angle of at least 12.5° from vertical, a coupling member at one end for coupling said foot bearing bar to a longitudinally adjacent second foot bearing bar, and a socket at the other end for receiving a coupling member of a longitudinally adjacent third foot bearing bar.

15. A signaling device according to claim 14, wherein said one end of said foot bearing bar is concavely curved and said other end of said foot bearing bar is convexly curved, said coupling member comprising an upwardly extending element mounted on a horizontally extending clip secured to said concavely curved end of said foot bearing bar such that said element is disposed substantially at the center of curvature of said concavely curved end, and said socket being disposed substantially at the center of curvature of said convexly curved end of said foot bearing bar, and a horizontally recess extending from said convexly curved end of said foot bearing bar to said socket for receiving said horizontally extending clip of a longitudinally adjacent foot bearing bar.

16. A signaling device according to claim 15, wherein said upwardly extending element and said socket have corresponding rectangular cross sectional configurations, and said socket is sufficiently larger than said element and said horizontal recess is sufficiently larger than said horizontally extending clip that said element can pivot in said socket up to 1°.

17. A signaling device according to claim 14, wherein said foot bearing bar has a substantially smaller width at the top than at its bottom, the bottom adjoins substantially vertical longitudinal sidewalls one each side having a height in the range from 15 to 25 mm, each of said vertical longitudinal sidewalls adjoins a convexly curved first transition region, the top also adjoins a convexly curved longitudinally extending second transition regions on each side, and the convexly curved first and second transition regions on each side of said foot bearing bar are joined by a concavely curved wall portion.

18. A signaling device according to claim 17, wherein said foot bearing bar has a top width of about 130 mm, said convexly curved transition regions have a radius of curvature of at least about 20 mm, and said concavely curved wall portions have a radius of curvature of about 78 mm.

19. A signaling device according to claim 14, wherein said foot bearing bar is provided on its underside with at least two foot knobs at each end thereof, said foot knobs being arranged in pairs substantially symmetrically on opposite sides of the longitudinal center of said foot bearing bar, and said knobs being formed of a material which is softer than said foot bearing bar.

20. A signaling device according to claim 19, wherein each foot knob is formed by a cylindrical recess of predetermined depth in the underside of said holding device and a mating cylindrical insert having a height which exceeds the predetermined depth of said recess by at least 3 mm.

21. A signaling device according to claim 2, wherein a grip hole is arranged in said solid top, and a slit is formed between said grip hole and a top edge of said signaling body, thereby preventing undesired snagging of said grip hole.

22. A signaling device according to claim 1, further comprising a retaining member for retaining said signaling body on said holding member, said retaining member comprising a retaining nose on said plate member, said nose having an inclined surface for facilitating sliding of said signaling body over said nose in the direction of insertion of said enlarged portions into said grooves and a catch surface for catching an edge of said signaling body after said signaling body has been slid over said nose.

* * * * *